US008105050B2

(12) United States Patent
Yamada et al.

(10) Patent No.: US 8,105,050 B2
(45) Date of Patent: Jan. 31, 2012

(54) EJECTOR AND MANUFACTURING METHOD THEREOF

(75) Inventors: Etsuhisa Yamada, Kariya (JP); Haruyuki Nishijima, Obu (JP); Kazunori Mizutori, Toyohashi (JP); Gouta Ogata, Nisshin (JP); Hideya Matsui, Kariya (JP); Hiroshi Oshitani, Toyota (JP); Youhei Nagano, Iwakura (JP)

(73) Assignee: Denso Corporation, Kariya (JP)

( * ) Notice: Subject to any disclaimer, the term of this patent is extended or adjusted under 35 U.S.C. 154(b) by 352 days.

(21) Appl. No.: 12/455,091

(22) Filed: May 28, 2009

(65) Prior Publication Data

US 2009/0297367 A1 Dec. 3, 2009

(30) Foreign Application Priority Data

May 29, 2008 (JP) ..... 2008-140828
May 29, 2008 (JP) ..... 2008-140829
Mar. 31, 2009 (JP) ..... 2009-085406

(51) Int. Cl.
*F25B 1/06* (2006.01)

(52) U.S. Cl. ..... 417/151; 417/198

(58) Field of Classification Search ..... 417/151, 417/174, 198; 62/170, 500; 29/888.02
See application file for complete search history.

(56) References Cited

U.S. PATENT DOCUMENTS 4,041,981 A * 8/1977 Davis et al. ..... 261/64.1
4,597,716 A * 7/1986 Evenson ..... 417/181
2003/0213264 A1 11/2003 Ogata et al.
2005/0178150 A1 8/2005 Oshitani et al.
2005/0183448 A1 8/2005 Ogata et al.
2005/0268644 A1 12/2005 Oshitani et al.
2007/0186572 A1 8/2007 Nishida et al.
2008/0264097 A1 10/2008 Ishizaka et al.

FOREIGN PATENT DOCUMENTS

JP 45-8591 3/1970
JP 53-69908 6/1978

OTHER PUBLICATIONS

Search Report and Written Opinion dated Jan. 21, 2010 in corresonding SG Application No. 200903451-3.
Office action dated May 11, 2011 in corresponding Chinese Application No. 2009 10202860.2.
Office action dated Jun. 1, 2010 in corresponding Japanese Application No. 2009-085406.

* cited by examiner

*Primary Examiner* — Karabi Guharay
(74) *Attorney, Agent, or Firm* — Harness, Dickey & Pierce, PLC

(57) ABSTRACT

A housing is configured into a tubular form and receives at least a portion of an ejector functional unit, which includes a nozzle and a body. A housing side opening radially penetrates through an outer peripheral wall surface and an inner peripheral wall surface of the housing and communicates with the fluid suction opening of the body. The housing side opening is adapted to join with a suction opening side external device, through which the fluid is drawn into the fluid suction opening.

23 Claims, 14 Drawing Sheets

EJECTOR AND MANUFACTURING METHOD THEREOF

CROSS REFERENCE TO RELATED APPLICATION

This application is based on and incorporates herein by reference Japanese Patent Application No. 2008-140828 filed on May 29, 2008, Japanese Patent Application No. 2008-140829 filed on May 29, 2008 and Japanese Patent Application No. 2009-085406 filed on Mar. 31, 2009.

BACKGROUND OF THE INVENTION

1. Field of the Invention

The present invention relates to an ejector and a manufacturing method thereof.

2. Description of Related Art

In a case of a previously known ejector, a fluid is drawn from a fluid suction opening by a vacuum force created by high velocity fluid discharged from a nozzle, which depressurizes and expands the high velocity fluid. In this type of ejector, the discharged fluid, which is discharged from the nozzle, and the drawn fluid, which is drawn through the fluid suction opening, are mixed to form the fluid mixture. Then, the kinetic energy of the fluid mixture is converted into the pressure energy at a pressurizing portion (a diffuser portion), so that the pressure of the fluid mixture is increased.

For example, Japanese Unexamined Patent Publication No. 2005-308380 (corresponding to US 2005/0178150A1 and US 2005/0268644A1) discloses an ejector refrigeration cycle, which uses an ejector as a refrigerant depressurizing means for depressurizing the pressure of the refrigerant. In this ejector refrigeration cycle, a drive force of a compressor is reduced by the pressurizing action of the ejector, so that a coefficient of performance (COP) of the refrigeration cycle is improved.

Furthermore, in Japanese Unexamined Patent Publication No. 2007-057222 (US 2008/0264097A1), the ejector refrigeration cycle is applied to a vehicle refrigeration cycle system. In this ejector refrigeration cycle, the ejector and another constituent device (e.g., an evaporator) of the refrigeration cycle are integrated together to reduce an entire size of the ejector refrigeration cycle and to improve an installability of the ejector refrigeration cycle.

In the ejector refrigeration cycle, for example, a flow quantity of the circulated refrigerant, which is circuited in the ejector refrigeration cycle, is changed according to a required performance of the refrigeration cycle. Therefore, it is also required to appropriately change the specification of the ejector by changing the sizes of, for example, the nozzle and the diffuser portion of the ejector according to the required performance of the refrigeration cycle to implement the above-described improvement in the coefficient of performance (COP).

Furthermore, in general, the constituent devices of the ejector refrigeration cycle, such as the compressor, the radiator, the ejector and the evaporator, are separately constructed and are connected together through refrigerant pipes or through direct connection.

Therefore, in the case where the ejector refrigeration cycle is applied to different refrigeration cycle systems, which have different required performances, when the specification of the ejector is changed to change the outer sizes of the ejector and the shapes of the connections of the ejector connected to the other constituent devices of the refrigeration cycle, the installability of the ejector relative to the other constituent devices (external devices) of the refrigeration cycle may possibly be deteriorated.

Particularly, in the case where the ejector and the other constituent device (external device) of the ejector refrigeration cycle are integrated together like in the case of Japanese Unexamined Patent Publication No. 2007-057222 (US 2008/0264097A1), the ejector and the other constituent device cannot be integrated together when the outer sizes of the ejector and the shapes of the connections of the ejector are changed due to the existence of the installation space limitations of the ejector.

However, it is difficult to change the specification of the ejector without changing the outer sizes of the ejector and the shapes of the connections of the ejector due to the requirements of the high precision at the time of manufacturing the nozzle or the diffuser portion of the ejector.

Also, in the case where the ejector is connected to the other constituent devices (the external devices) of the ejector refrigeration cycle, when the connections are made by heating the connections to the high temperature like in the case of the brazing, the thermal deformation may possibly occur to the corresponding parts of the ejector. In view of this, it is conceivable to use mechanical fastening, such as fastening using a union and a nut, which are tightened together. However, in the case of the mechanical fastening, the corresponding parts of the ejector may possibly be deformed by, for example, the torsional stress applied at the time of tightening the union and the nut together.

When such a deformation occurs in the corresponding parts of the ejector, the performance (the pressurizing performance, i.e., the pressure increasing performance) of the ejector may possibly be deteriorated.

SUMMARY OF THE INVENTION

The present invention addresses the above disadvantages.

According to the present invention, there is provided an ejector, which includes an ejector functional unit and a housing. The ejector functional unit includes a nozzle and a body. The nozzle depressurizes and expands high pressure fluid supplied thereto. The body is directly or indirectly joined to the nozzle and has a fluid suction opening and a pressurizing portion. Fluid is drawn into an interior of the body through the fluid suction opening of the body by a vacuum force created by high velocity fluid that is discharged from the nozzle. A mixture of the fluid discharged from the nozzle and the fluid drawn through the fluid suction opening is pressurized in the pressurizing portion. The housing is configured into a tubular form and receives at least a portion of the ejector functional unit. A housing side opening radially penetrates through an outer peripheral wall surface and an inner peripheral wall surface of the housing and communicates with the fluid suction opening of the body. The housing side opening is adapted to directly or indirectly join with a suction opening side external device, through which the fluid is drawn into the fluid suction opening.

According to the present invention, there is also provided a manufacturing method for manufacturing an ejector. According to the manufacturing method, a nozzle is inserted into an interior of a body to form an ejector functional unit. Then, the body is inserted into an interior of a housing. Next, after the inserting of the nozzle into the interior of the body and the inserting of the body into the interior of the housing, the nozzle and the body are directly or indirectly joined together, and also the body and the housing are directly or indirectly joined together.

Also, there may be provided another manufacturing method for manufacturing an ejector. According to the manufacturing method, a nozzle and a body are connected together to form an ejector functional unit. Then, a downstream end portion of a first cover is connected to a first opening of a block, and also an upstream end portion of a second cover is connected to a second opening of the block to form a housing that receives the ejector functional unit. Next, the ejector functional unit is fixed into the housing such that an upstream side portion of the ejector functional unit, at which the nozzle is located, is received in the first cover while a downstream side portion of the ejector functional unit, at which a pressurizing portion is located, is received in the second cover, and a third opening of the block is communicated with a fluid suction opening of the body.

Furthermore, there may be also provided a further manufacturing method for manufacturing an ejector. According to the manufacturing method, a nozzle and a body are connected together to form an ejector functional unit. Then, an upstream side portion of the ejector functional unit, at which the nozzle is located, is connected to a first cover of a housing. Next, a second cover of the housing is connected to the first cover after the connecting of the upstream side portion of the ejector functional unit to the first cover such that the second cover does not contact a downstream end portion of the ejector functional unit, at which a pressurizing portion is located.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

Figure 1:
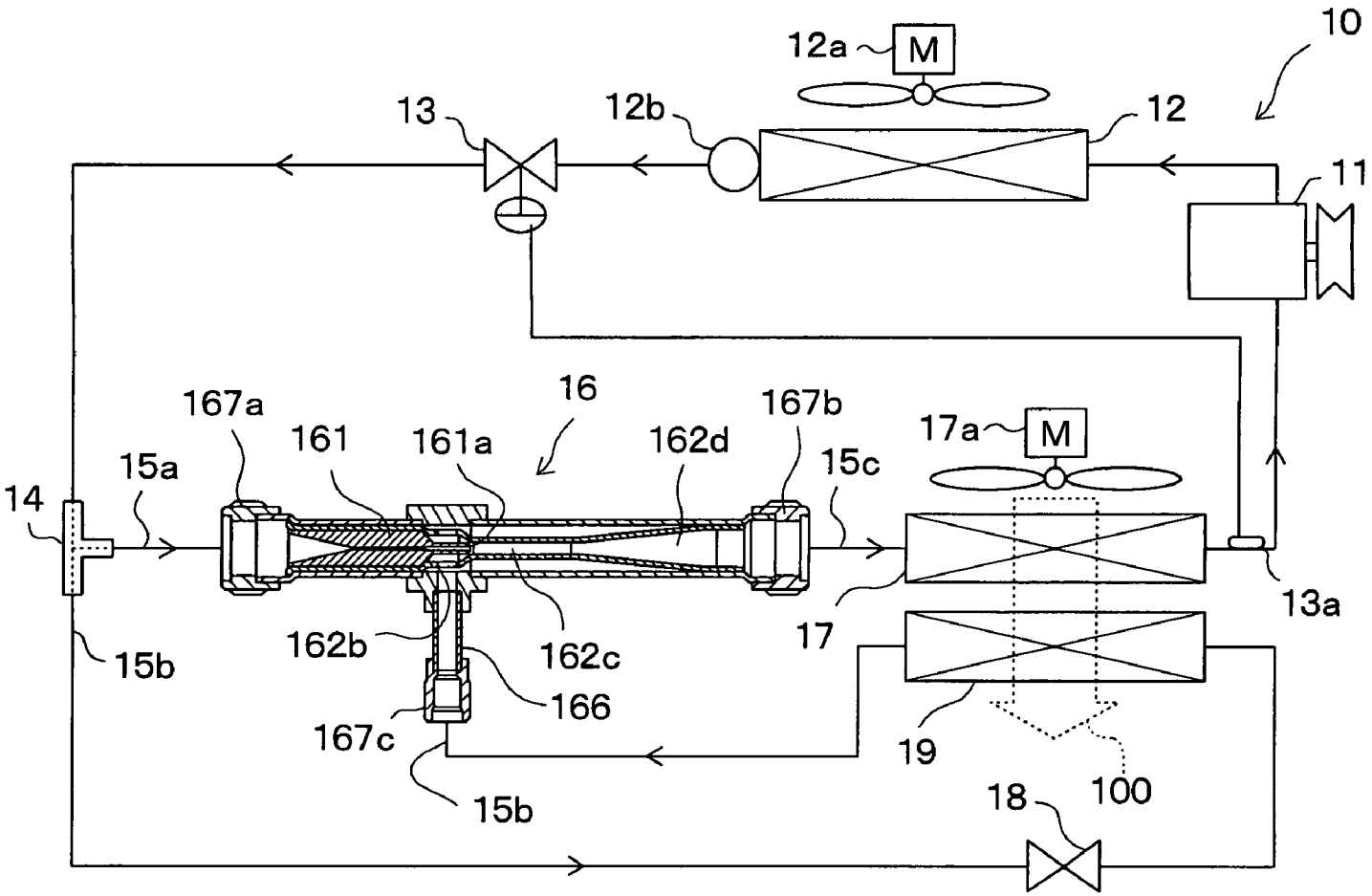
FIG. 1 is a schematic diagram showing an ejector refrigeration cycle according to a first embodiment of the present invention.

A first embodiment of the present invention will be described with reference to FIGS. 1 to 3. According to the present embodiment, an ejector refrigeration cycle 10, which includes an ejector 16, is applied to a vehicle air conditioning system. FIG. 1 schematically shows an entire structure of the ejector refrigeration cycle 10. In the ejector refrigeration cycle 10, a compressor 11 draws refrigerant (fluid) and compresses the drawn refrigerant. The compressor 11 is rotated by a drive force, which is transmitted from a vehicle drive engine (not shown) through, for example, an electromagnetic clutch and a belt.

The compressor 11 may be a variable displacement compressor or a fixed displacement compressor. In the case of the variable displacement compressor, a refrigerant delivery rate can be adjusted by changing a displacement of the variable displacement compressor. In the case of the fixed displacement compressor, a refrigerant delivery rate can be adjusted by changing a working rate of the compressor by coupling and decoupling the electromagnetic clutch. Furthermore, when an electric compressor is used as the compressor 11, the refrigerant delivery rate can be adjusted by adjusting a rotational speed (the number of rotations per unit time) of a corresponding electric motor.

A radiator 12 is connected to a refrigerant outlet opening of the compressor 11. The radiator 12 is a heat radiating heat exchanger, which cools the high pressure refrigerant by exchanging heat between the high pressure refrigerant, which is discharged from the compressor 11, and the vehicle outside air (the air at the outside of the passenger compartment of the vehicle), which is blown by a cooling fan 12*a*. The cooling fan 12*a* is an electric blower, a rotational speed (an air delivery rate) of which is controlled by a control voltage that is outputted from an air conditioning control device (not shown).

The ejector refrigeration cycle 10 of the present embodiment uses a typical chlorofluorocarbon refrigerant as the refrigerant thereof and forms a subcritical cycle, in which the upper side (high pressure side) refrigerant pressure does not exceed beyond a subcritical pressure of the refrigerant. The radiator 12 serves as a condenser, which condenses the refrigerant.

A liquid receiver 12*b* is connected to an outlet opening of the radiator 12. The liquid receiver 12*b* is a gas-liquid separator, which separates the refrigerant discharged from the radiator 12 into the liquid phase refrigerant and the gas phase refrigerant and accumulates the excessive liquid phase refrigerant therein. In the present embodiment, the radiator 12 and the liquid receiver 12*b* are formed integrally. However, it should be noted that the radiator 12 and the liquid receiver 12*b* may be formed separately from each other.

An expansion valve 13, which is a thermostatic expansion valve of a known type, is connected to a liquid phase refrigerant outlet opening of the liquid receiver 12*b*. The expansion valve 13 is a depressurizing means for depressurizing and expanding the high pressure liquid phase refrigerant, which is outputted from the liquid receiver 12*b*, into the intermediate pressure refrigerant, which includes a mixture of the gas phase refrigerant and the liquid phase refrigerant. The expansion valve 13 also serves as a flow quantity adjusting means for adjusting the flow quantity of the refrigerant, which is supplied on the downstream, side of the expansion valve 13 in the refrigeration cycle 10.

Specifically, the expansion valve 13 includes a temperature sensing device 13*a*, which is placed in a first evaporator 17 outlet opening side refrigerant passage (i.e., a refrigerant passage located on the outlet opening side of a first evaporator 17) described below to sense a degree of superheat of the refrigerant on the outlet opening side of the first evaporator 17 based on the temperature and the pressure of the refrigerant on the outlet opening side of the first evaporator 17. The expansion valve 13 mechanically adjusts a degree of opening (the refrigerant flow quantity) thereof in such a manner that the degree of superheat of the refrigerant on the outlet opening side of the first evaporator 17 becomes a predetermined value.

A branch connection 14 is inserted in, i.e., is connected to the path of the refrigeration cycle 10 on the downstream side of the expansion valve 13 to divide the flow of the intermediate pressure refrigerant, which is depressurized and expanded through the expansion valve 13. The branch connection 14 forms a three-way coupling structure, which has three fluid inlet/outlet openings. One of the three fluid inlet/outlet openings is a refrigerant flow inlet opening, and the remaining two of the three inlet/outlet openings are refrigerant flow outlet openings. This type of the branch connection 14 may be formed by joining pipes, which have different pipe diameters, respectively. Alternatively, the branch connection 14 may be formed by providing refrigerant passages, which have different passage diameters.

Furthermore, a first refrigerant pipe 15*a* is connected to one of the refrigerant flow outlet openings of the branch connection 14 to connect between the branch connection 14 and an inlet opening of a nozzle 161 of the ejector 16 described below. Also, a second refrigerant pipe 15*b* is connected to the other one of the refrigerant flow outlet openings of the branch connection 14 to connect between the branch connection 14 and a refrigerant suction opening 162*b* of the ejector 16.

The ejector 16 has a function of depressurizing means for depressurizing the refrigerant, which is supplied to the ejector 16 through the first refrigerant pipe 15*a*. The ejector 16 also has a function of refrigerant circulating means for circulating the refrigerant by the suction action (vacuum force) of the discharged refrigerant (jetted refrigerant), which is discharged, i.e., is jetted from the nozzle 161. Now, the structure of the ejector 16 will be described in detail with reference to FIG. 2. FIG. 2 is an axial cross-sectional view of the ejector 16.

The ejector 16 of the present embodiment includes an ejector functional unit 160, a housing 170 and a suction opening side pipe 166. The ejector functional unit 160 includes the nozzle 161 and a body 162, which are integrally connected together, i.e., are integrally joined together. The housing 170 includes a first cover 163, a second cover 164 and a block 165, which are connected together, i.e., are joined together. The suction opening side pipe 166 is connected to the block 165.

The nozzle 161 is made of metal (e.g., brass or stainless alloy) and is configured into a generally cylindrical tubular form. In the nozzle 161, a cross-sectional area of a refrigerant passage, to which the refrigerant is supplied from the first refrigerant pipe 15*a*, is narrowed to isenthalpically depressurize and expand the refrigerant. In the present embodiment, the nozzle 161 is a Laval nozzle that has a throat, at which the cross-sectional area of the refrigerant passage is minimized. Here, it should be noted that the nozzle 161 may be alternatively formed as a convergent nozzle.

The body 162 is a tubular member, which is made of metal (e.g., aluminum) and is configured into a generally cylindrical tubular form. The body 162 includes a fixing portion 162*a*, refrigerant suction openings (fluid suction openings) 162*b*, a mixing portion 162*c* and a diffuser portion 162*d*, which are arranged in this order one after another in a flow direction (a refrigerant flow direction) of the refrigerant. Furthermore, an inner diameter of the body 162 changes along its length in conformity with the functions of the above-described portions 162*a*-162*d* of the body 162.

The fixing portion 162*a* is a supporting and fixing portion, into which the nozzle 161 is press fitted. Therefore, the inner diameter of the body 162 at the fixing portion 162*a* is slightly smaller than an outer diameter of the nozzle 161. When the nozzle 161 is press fitted into and is secured to the fixing portion 162*a*, the nozzle 161 and the body 162 are connected together to form the ejector functional unit 160.

Each refrigerant suction opening 162*b* is formed as a through hole, which radially extends through the wall of the body 162 to communicate between the outside and the inside of the body 162. Furthermore, the refrigerant suction openings 162*b* of the body 162 are communicated with a refrigerant discharge opening 161*a* of the nozzle 161. The refrigerant, which is discharged from a second evaporator 19 described below, is drawn into the interior of the body 162 through the refrigerant suction openings 162*b*. An inner diameter of a portion of the body 162, which extends from the refrigerant suction openings 162*b* to the mixing portion 162*c*, is progressively reduced toward the downstream side (the right side in FIG. 2) to conform with a shape of a distal end portion (a downstream end portion) of the nozzle 161.

The mixing portion 162*c* forms a mixing space (a mixing chamber), in which the refrigerant discharged from the refrigerant discharge opening 161*a* of the nozzle 161 is mixed with the refrigerant drawn through the refrigerant suction opening 162*b* to form the refrigerant mixture. The inner diameter of the body 162 in the mixing portion 162*c* is generally constant along its length.

The inner diameter of the body 162 at the diffuser portion 162*d* is progressively increased toward the downstream side, and thereby the cross-sectional area of the refrigerant passage of the diffuser portion 162*d* is also progressively increased toward the downstream side. In this way, the diffuser portion 162*d* reduces the velocity of the refrigerant flow (the refrigerant mixture) to increase the refrigerant pressure. That is, the diffuser portion 162*d* converts the velocity energy of the refrigerant into the pressure energy of the refrigerant. The outer diameter of the body 162 changes in response to the change in the inner diameter of the body 162.

The block 165 is made of metal (e.g., aluminum or copper) and is configured into a generally cylindrical tubular form or a generally prismatic or polygonal tubular form, which extends in the axial direction (the refrigerant discharging direction, i.e., the jet direction) of the nozzle 161. Furthermore, the block 165 has first to third openings 165*a*-165*c*. Before the assembling operation of the block 165 to the other components of the ejector 16, the first to third openings 165*a*-165*c* communicate with each other.

An inner diameter of the first opening 165*a* is generally the same as an inner diameter of the second opening 165*b*. Furthermore, the first opening 165*a* and the second opening 165*b* extend in the axial direction of the nozzle 161 and cooperate with each other to form one through hole in the block 165. The third opening 165*c* extends in the direction generally perpendicular to the axial direction of the first opening 165*a* and of the second opening 165*b*. Furthermore, the third opening 165*c* is communicated with the refrigerant suction opening 162*b* of the body 162.

One end portion (downstream end portion) of the first cover 163 is connected to the first opening 165*a*, and one end portion (upstream end portion) of the second cover 164 is connected to the second opening 165*b*. The first cover 163 and the second cover 164 are made of the metal, which is the same as that of the block 165, and are configured into tubular bodies, respectively. Furthermore, the first cover 163 and the second cover 164 are joined to the block 165 by brazing.

Alternatively, the first cover 163 and the second cover 164 may be refrigerant pipes, on which a pipe expanding process and/or a hole forming process are performed. When the first cover 163 and the second cover 164 are joined to the block 165, the housing 170, which receives the ejector functional unit 160, is formed.

Figure 2:
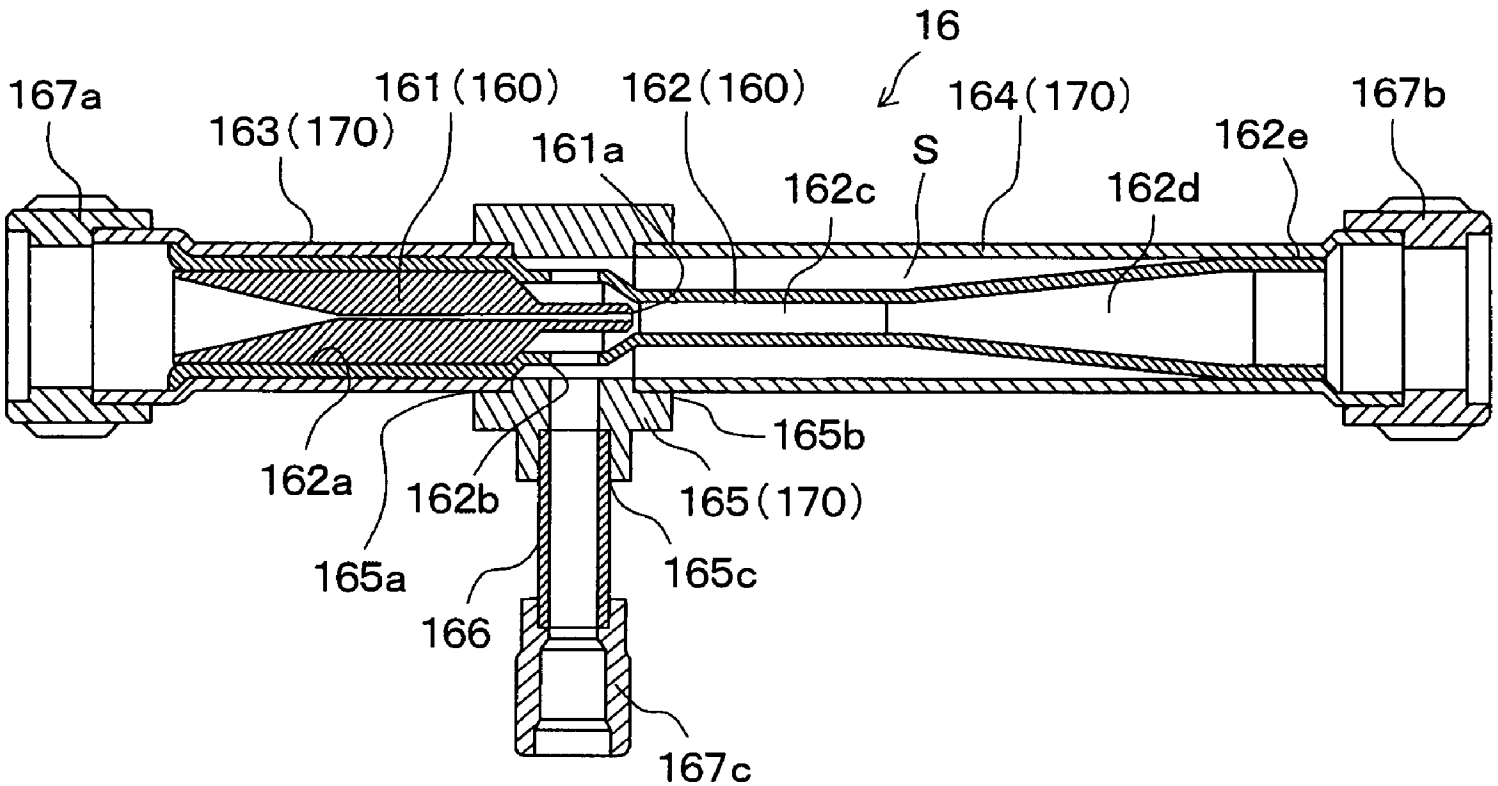
FIG. 2 is an enlarged cross-sectional view of an ejector of the ejector refrigeration cycle according to the first embodiment.

With reference to FIG. 2, in the state where the ejector functional unit 160 is received in the housing 170, the first cover 163 receives the nozzle 161 side portion (upstream side portion) of the ejector functional unit 160, and the second cover 164 receives the body 162 side portion (downstream side portion) of the ejector functional unit 160. Furthermore, the block 165 receives an intermediate portion (a portion around the refrigerant suction openings 162*b*) of the ejector functional unit 160.

At this time, the nozzle 161 side portion (upstream side portion) of the ejector functional unit 160 is securely press fitted into the interior of the first cover 163, so that an outer peripheral wall surface of the ejector functional unit 160 and the inner peripheral wall surface of the first cover 163 contact with each other without forming a gap therebetween. In other words, the upstream side portion of the ejector functional unit 160 is fluid-tightly sealed to the first cover 163. Therefore, the refrigerant will not leak to the outside through the connection between the inner peripheral wall surface of the first cover 163 and the outer peripheral wall surface of the ejector functional unit 160.

An annular space (annular gap) S, which circumferentially extends all around the ejector functional unit 160 (more specifically, the body 162), is radially defined between the inner peripheral wall surface of the housing 170 (more specifically, the second cover 164 and the block 165) and the outer peripheral wall surface of the ejector functional unit 160 (more specifically, the body 162) at an axial intermediate location between the upstream end portion and the downstream end portion of the ejector functional unit 160. The annular space S is radially interposed between the refrigerant suction openings 162*b* and the third opening (housing side opening) 165*c* to communicate therebetween. The outer peripheral wall surface of the distal end portion (downstream end portion) 162*e* at the refrigerant flow outlet opening side (more specifically, the diffuser portion 162*d* side portion) of the body 162 contacts the inner peripheral wall surface of the second cover 164 all around the distal end portion 162*e*.

One end portion (downstream end portion) of the suction opening side pipe 166 is joined to the third opening 165*c* of the block 165 by brazing. The suction opening side pipe 166 is a refrigerant pipe, which conducts the refrigerant (the fluid) to be drawn into the refrigerant suction openings 162*b*.

First to third unions (fastening members) 167*a*-167*c* are provided to the other end portion (upstream end portion) of the first cover 163, the other end portion (downstream end portion) of the second cover 164 and the other end portion (upstream end portion) of the suction opening side pipe 166, respectively. The first to third unions 167*a*-167*c* form first and second connecting portions and a suction opening side connecting portion, respectively, which are connected to the other constituent devices (external devices) of the ejector refrigeration cycle 10.

Alternatively, the first to third unions 167*a*-167*c* may be joined to the other end portion of the first cover 163, the other end portion of the second cover 164 and the other end portion of the suction opening side pipe 166, respectively, by any other joining means, such as brazing, welding or bonding. Further alternatively, the first to third unions 167*a*-167*c* may be directly formed at the other end portion of the first cover 163, the other end portion of the second cover 164 and the other end portion of the suction opening side pipe 166, respectively.

Figure 3:
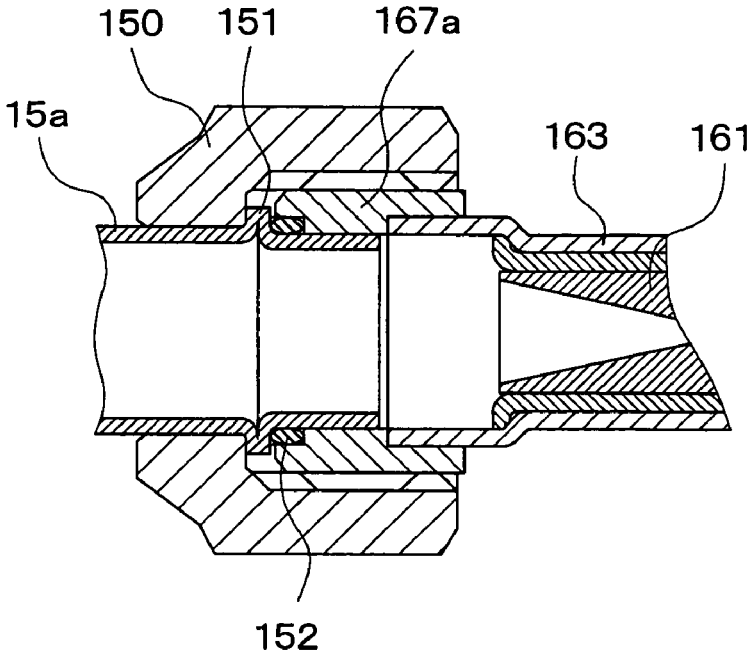
FIG. 3 is an enlarged partial cross-sectional view of a connection between the ejector and an external device of the ejector refrigeration cycle according to the first embodiment.

Now, with reference to FIG. 3, the connection between each of the above-described external devices and the corresponding union will be specifically described in view of the exemplary case of the first union 167*a*, which forms the connecting portion of the first cover 163. The first refrigerant pipe 15*a*, which serves as the external device (the nozzle side external device), is connected to the first union 167*a*. FIG. 3 is an enlarged cross-sectional view of the first refrigerant pipe 15*a* and the first union 167*a*, which are connected together.

As shown in FIG. 3, a nut 150 is rotatably supported by an outer peripheral surface of the first refrigerant pipe 15*a*. Furthermore, the nut 150 is configured to threadably engage a threaded portion (screw thread), which is formed in an outer peripheral surface of the first union 167*a*. Furthermore, a removal limiting portion 151 is provided in the outer peripheral surface of the distal end portion (downstream end portion) of the first refrigerant pipe 15*a* and circumferentially extends all around the distal end portion of the first refrigerant pipe 15*a*. The removal limiting portion 151 limits removal of the nut 150 from the first refrigerant pipe 15*a*.

Then, in the engaged state of the first union 167*a* where the distal end portion of the first refrigerant pipe 15*a* is placed in the first union 167*a*, the nut 150 is tightened against the threaded portion (screw thread) of the first union 167*a*. Thereby, the first refrigerant pipe 15*a* is connected to the ejector 16. At this time, an O-ring 152 is interposed between the first union 167*a* and the removal limiting portion 151 to fluid-tightly seal the connection, i.e., to limit leakage of the refrigerant to the outside through a gap between the first refrigerant pipe 15*a* and the first union 167*a*.

Furthermore, as shown in FIG. 1, the first evaporator 17 is connected to the outlet opening of the ejector 16 (specifically, the diffuser portion 162*d* of the body 162) through a third refrigerant pipe 15*c*. That is, the third refrigerant pipe 15*c*, which serves as the external device (a pressurizing portion side external device), is connected to the second union 167*b*. The third refrigerant pipe 15*c* and the second union 167*b* are connected together in a manner similar to that of the first refrigerant pipe 15*a* and the first union 167*a* described above.

The first evaporator 17 is a heat absorbing heat exchanger, which absorbs heat by exchanging the heat between the low pressure refrigerant discharged from the ejector 16 and the blown vehicle inside air (the air at the inside of the passenger compartment of the vehicle), which is blown by a blower fan 17*a*, so that the low pressure refrigerant is evaporated at the first evaporator 17. The blower fan 17*a* is an electric blower, a rotational speed (an air delivery rate) of which is controlled by a control voltage that is outputted from the air conditioning control device (not shown). A refrigerant suction opening of the compressor 11 is connected to the outlet opening of the first evaporator 17.

A fixed choke (a choke having a passage of a fixed cross-sectional size) 18 and the second evaporator 19 are installed in the second refrigerant pipe 15*b*. The fixed choke 18 is a depressurizing means for depressurizing the refrigerant to be supplied into the second evaporator 19. In the present embodiment, a capillary tube is used as the fixed choke 18. Alternatively, an orifice may be used as the fixed choke 18.

The second evaporator 19 is a heat absorbing heat exchanger, which absorbs heat by exchanging the heat between the refrigerant discharged from the fixed choke 18 and the blown vehicle inside air, which is blown by the blower fan 17*a*, so that the low pressure refrigerant is evaporated at the second evaporator 19. Here, the first evaporator 17 is placed on the upstream side of the second evaporator 19 in the flow direction of the air, which is blown by the blower fan 17*a*. In other words, the second evaporator 19 is placed on the downstream side of the first evaporator 17 in the flow direction of the air.

The air, which is blown by the blower fan 17*a*, flows in the direction of an arrow 100 shown in FIG. 1. First, the air; which is blown by the blower fan 17*a*, is cooled at the first evaporator 17 upon exchanging the heat with the refrigerant discharged from the ejector 16. Then, this air is further cooled at the second evaporator 19 upon exchanging the heat with the refrigerant discharged from the fixed choke 18.

Furthermore, the second refrigerant pipe 15*b* is connected to the suction opening side pipe 166, so that the outlet opening of the second evaporator 19 is connected to the refrigerant suction opening 162*b* of the ejector 16. That is, the second refrigerant pipe 15*b*, which serves as the external device (a suction opening side external device), is connected to the third union 167*c*. The third refrigerant pipe 15*c* and the second union 167*b* are connected together in a manner similar to that of the first refrigerant pipe 15*a* and the first union 167*a* described above.

Next, the operation of the ejector refrigeration cycle 10 will be described. When the drive force is transmitted from the engine to the compressor 11, the compressor 11 draws and compresses the refrigerant, which is then discharged from the compressor 11. The high temperature and high pressure refrigerant, which is discharged from the compressor 11, is cooled and is condensed at the radiator 12. Thereafter, at the liquid receiver 12*b*, the refrigerant is separated into the gas phase refrigerant and the liquid phase refrigerant.

The high pressure liquid phase refrigerant, which is separated at the liquid receiver 12*b*, is decompressed and expanded at the expansion valve 13. At this time, the degree of opening of the expansion valve 13 is adjusted such that the degree of superheat of the refrigerant (the refrigerant flow quantity) at the outlet opening of the first evaporator 17 (the refrigerant supplied to the compressor 11) substantially coincides with a predetermined value. The intermediate pressure refrigerant, which is depressurized and is expanded at the expansion valve 13, is supplied to the branch connection 14, at which the refrigerant is divided into the refrigerant flow, which is guided to the first refrigerant pipe 15*a*, and the refrigerant flow, which is guided to the second refrigerant pipe 15*b*.

The refrigerant, which is supplied to the ejector 16 through the first refrigerant pipe 15*a*, is isenthalpically depressurized and expanded through the nozzle 161 and is then discharged from the refrigerant discharge opening 161*a* as the high velocity refrigerant flow. Then, due to the vacuum action of the refrigerant, which is discharged through the refrigerant discharge opening 161*a* and creates the vacuum force (suctioning force), the refrigerant, which is discharged from the second evaporator 19, is drawn into the interior of the body 162 through the refrigerant suction openings 162*b* through the suction opening side pipe 166.

Then, in the mixing portion 162*c*, the discharged refrigerant, which is discharged from the nozzle 161, is mixed with the drawn refrigerant, which is drawn through the refrigerant suction openings 162*b*. Thereafter, the mixed refrigerant (refrigerant mixture) is supplied into the diffuser portion 162*d*. At the diffuser portion 162*d*, the velocity energy of the refrigerant is converted into the pressure energy, so that the pressure of the refrigerant is increased. The refrigerant, which is outputted from the diffuser portion 162*d*, is supplied to the first evaporator 17.

At the first evaporator 17, the supplied low pressure refrigerant absorbs the heat from the blown vehicle inside air, which is blown by the blower fan 17*a*, so that the refrigerant is evaporated. In this way, the blown vehicle inside air, which is blown by the blower fan 17*a*, is cooled. Then, the gas phase refrigerant, which is discharged from the first evaporator 17, is drawn into the compressor 11 and is pressurized once again.

The refrigerant flow, which is supplied to the second refrigerant pipe 15*b*, is isenthalpically depressurized and expanded through the fixed choke 18 and is thereafter supplied to the second evaporator 19. The refrigerant, which is supplied to the second evaporator 19, absorbs the heat from the blown vehicle inside air, which is supplied to the second evaporator 19 upon being blown by the blower fan 17*a* and passing through the first evaporator 17, so that the refrigerant is evaporated. In this way, the blown vehicle inside air is further cooled and is then blown into the interior of the passenger compartment.

The refrigerant, which is outputted from the second evaporator 19, is drawn into the ejector 16 through the suction opening side pipe 166 and the refrigerant suction openings 162*b*.

As described above, in the ejector refrigeration cycle 10 of the present embodiment, the blown air, which is blown by the blower fan 17*a*, passes the first evaporator 17 and then the second evaporator 19 to cool the common subject cooling space (passenger compartment of the vehicle).

At this time, the refrigerant evaporation temperature of the first evaporator 17 is made higher than the refrigerant evaporation temperature of the second evaporator 19 due to the pressurizing action of the diffuser portion 162*d*. Thereby, it is possible to implement the sufficient temperature difference between the refrigerant evaporation temperature of the first evaporator 17 and the temperature of the blown air as well as the sufficient temperature difference between the refrigerant evaporation temperature of the second evaporator 19 and the temperature of the blown air. As a result, the blown air can be effectively cooled.

Furthermore, since the downstream side portion (the outlet opening) of the first evaporator 17 is connected to the suction opening of the compressor 11, the refrigerant, which is pressurized at the diffuser portion 162*d*, can be drawn into the compressor 11. As a result, the inlet pressure of the compressor 11 is increased to reduce the drive power of the compressor 11, which is required to compress the refrigerant. Therefore, the coefficient of performance (COP) can be improved.

Next, the manufacturing method of the ejector 16 of the present embodiment will be described. First, a functional unit forming process is executed to form the ejector functional unit 160 by connecting the nozzle 161 and the body 162 together. Specifically, the nozzle 161 and the body 162 are connected together by press-fitting the nozzle 161 into the interior of the fixing portion 162*a* of the body 162.

Furthermore, separately from the functional unit forming process, a housing forming process is executed to form the housing 170 by integrating the block 165, the first cover 163 and the second cover 164 together. Specifically, one end portion (downstream end portion) of the first cover 163 and one end portion (upstream end portion) of the second cover 164 are temporarily fixed to the first opening 165*a* and the second opening 165*b*, respectively, of the block 165. Then, in the state where the one end portion (downstream end portion) of the suction opening side pipe 166 is temporarily fixed to the third opening 165*c* of the block 165, the housing 170 is placed in a furnace, which serves as a heating means.

In this way, a brazing material, which is previously placed over the outer surface of the first cover 163, the outer surface of the second cover 164 and the outer surface of the suction opening side pipe 166, is melted. When the brazing material is solidified once again upon cooling, the block 165, the first cover 163, the second cover 164 and the suction opening side pipe 166 are joined together by brazing, so that the housing 170 is formed.

At the time of executing the housing forming process, the first to third unions 167*a*-167*c* may be joined to the first cover 163, the second cover 164 and the suction opening side pipe 166, respectively, by the brazing. Furthermore, in the case where the first to third unions 167*a*-167*c* are joined by, for example, bonding or welding, the first to third unions 167*a*-167*c* may be joined the first cover 163, the second cover 164 and the suction opening side pipe 166, respectively, before or after the housing forming process.

Next, the ejector functional unit 160 is placed in and is fixed to the housing 170 by a non-thermal fixing means in a fixing process. Specifically, in this fixing process, the nozzle 161 side portion (upstream side portion) of the ejector functional unit 160 is press fitted into the first cover 163, so that ejector functional unit 160 is fixed to the housing 170.

In this way, the ejector 16 is formed such that the nozzle 161 side portion (upstream side portion) and the body 162 side portion (downstream side portion) of the ejector functional unit 160 are received in the first cover 163 and the second cover 164, respectively, and the refrigerant suction openings 162*b* are communicated with the third opening 165*c* of the block 165.

In the present embodiment, the ejector 16, which is manufactured in the above described manner, is used, so that the advantages described below can be implemented.

In the ejector 16 of the present embodiment, the ejector functional unit 160 is received in the housing 170. Therefore, even when the sizes of the ejector functional unit 160 are changed to change the specification of the ejector 16, the outer sizes of the ejector 16 are not changed.

Furthermore, the first to third unions 167*a*-167*c*, which are mechanically connected to the external devices, are provided to the first cover 163, the second cover 164 and the suction opening side pipe 166, respectively. Therefore, it is possible to improve the installability of the ejector 16 to the external devices.

Furthermore, the nozzle 161 and the body 162 are connected together to form the ejector functional unit 160. Therefore, the specification of the nozzle 161 and the specification of the body 162 can be changed independently. As a result, the change in the entire specification of the ejector 16 can be easily made, and the installability of the ejector 16 to the external devices can be improved.

In addition, the annular space S is formed between the outer peripheral surface of the ejector functional unit 160 (specifically, the body 162) and the inner peripheral surface of the second cover 164. Therefore, it is possible to reduce the weight of the ejector. Furthermore, due to the thermal insulating function of this annular space, it is possible to limit the evaporation of the liquid phase refrigerant in the interior of the body 162 at the time of operating the ejector refrigeration cycle 10. Therefore, the cooling capacity at the first evaporator 17 can be improved.

Also, at the time of manufacturing the ejector 16, the ejector functional unit 160 and the housing 170 are fixed together by the non-thermal fixing means at the time of forming the ejector 16. Therefore, heating of the ejector functional unit 160 can be avoided. Therefore, the thermal deformation of the nozzle 161 and the body 162, which require the high precision in terms of its sizes, can be avoided to avoid a reduction in the performance of the ejector.

Furthermore, in the case of Japanese Unexamined Patent Publication No. 2007-057222 (US 2008/0264097A1) where the ejector 16 and the other constituent device of the refrigeration cycle are integrated together, the installation space of the ejector 16 may be disadvantageously limited. In contrast, according to the present embodiment, even when the specification of the ejector 16 is changed, the outer sizes of the ejector 16 and the shapes of the connecting portions of the ejector 16 do not change. This is very effective in terms of the installation space.

Second Embodiment

Figure 4:
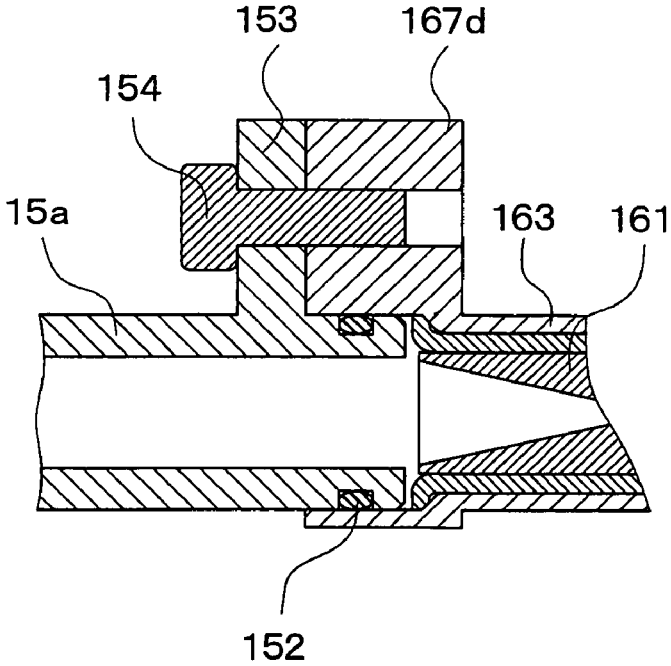
FIG. 4 is an enlarged partial cross-sectional view of a connection between an ejector and an external device of an ejector refrigeration cycle according to a second embodiment of the present invention.

In the first embodiment, the first union 167*a* is discussed as the example of the connecting portion of the ejector 16. In contrast, according to the second embodiment, as shown in FIG. 4, the connection portion of the ejector 16 includes a flange 167*d*, which is formed as a fastening member at the other end portion (upstream end portion) of the first cover 163 that is opposite from the end portion (downstream end portion) of the first cover 163 joined to the block 165. Furthermore, a flange 153 is formed at a connecting end portion (downstream end portion) of the first refrigerant pipe 15*a*. The flange 167*d* of the first cover 163 and the flange 153 of the first refrigerant pipe 15*a* are connected together to connect between the first cover 163 and the first refrigerant pipe 15*a*.

FIG. 4 is a partial axial cross-sectional view of the ejector 16 of the present embodiment. In FIG. 4, components, which are similar to those of the first embodiment, will be indicated by the same reference numerals. This is also true for the other remaining drawings discussed below.

Specifically, a through hole is formed through the flange 153 of the first refrigerant pipe 15*a* to receive a bolt 154 therethrough. Furthermore, a threaded hole is formed in the flange 167*d* of the first cover 163. The bolt 154 is received through the through hole of the flange 153 and is threadably, securely engaged with the threaded hole (specifically, a screw thread of the threaded hole) of the flange 167*d* of the first cover 163. In this way, the first refrigerant pipe 15*a* and the first cover 163 are connected together. The other remaining structure of the ejector 16 is the same as that of the first embodiment.

Even when the flange 167*d* is used to form the connecting portion of the ejector 16, advantages, which are similar to those of the first embodiment, can be achieved. Here, it should be noted that the second cover 164 and the third refrigerant pipe 15*c* may be connected together in a manner similar to that of the first refrigerant pipe 15*a* and the first cover 163 described above. Also, the suction opening side pipe 166 and the second refrigerant pipe 15*b* may be connected together in a manner similar to that of the first refrigerant pipe 15*a* and the first cover 163 described above.

Third Embodiment

In the first embodiment, the O-ring 152 is interposed between the first union 167*a* and the first refrigerant pipe 15*a*.

Figure 5:
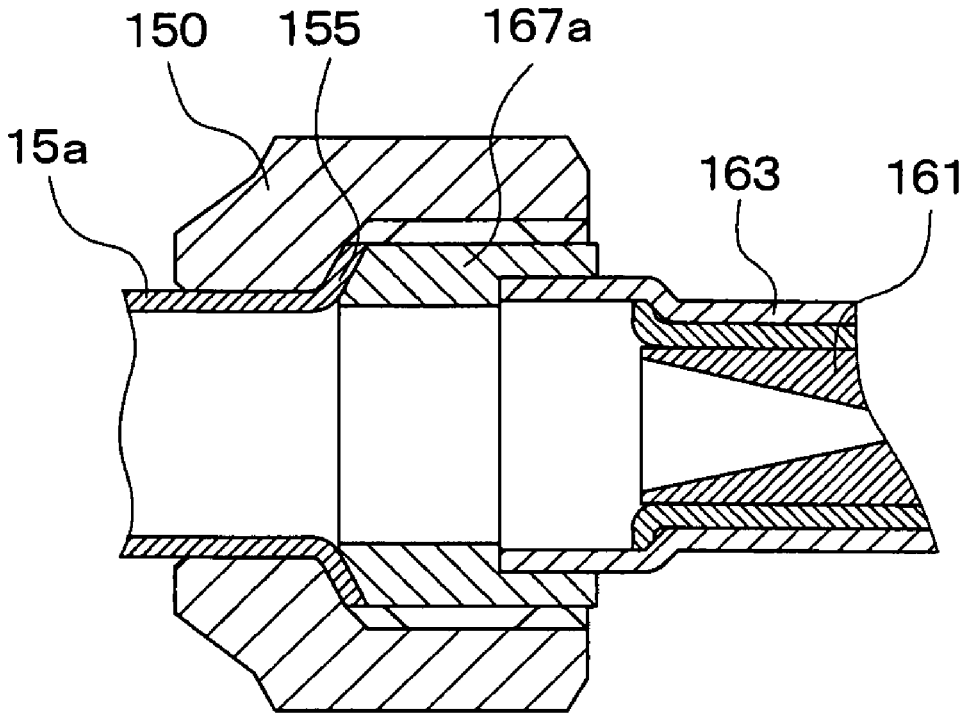
FIG. 5 is an enlarged partial cross-sectional view of a connection between the ejector and an external device of an ejector refrigeration cycle according to a third embodiment of the present invention.

In contrast, in a third embodiment of the present invention, as shown in FIG. 5, the O-ring 152 is eliminated, and a metal seal is provided to limit the leakage of the refrigerant through the gap between the first refrigerant pipe 15*a* and the first union 167*a*. FIG. 5 is a partial axial cross-sectional view of the ejector 16 of the present embodiment.

Specifically, a flared portion (diverging portion) 155 is formed in the connecting end portion (downstream end portion) of the first refrigerant pipe 15*a*. The flared portion 155 is clamped between the nut 150 and the first union 167*a*. The other remaining structure of the ejector 16 is the same as that of the first embodiment.

Even when the gap between the first refrigerant pipe 15*a* and the first union 167*a* is sealed in the above described manner, advantages, which are similar to those of the first embodiment, can be achieved. Here, it should be noted that the second cover 164 and the third refrigerant pipe 15*c* may be connected together in a manner similar to that of the first refrigerant pipe 15*a* and the first cover 163 discussed above. Also, the suction opening side pipe 166 and the second refrigerant pipe 15*b* may be connected together in a manner similar to that of the first refrigerant pipe 15*a* and the first cover 163 discussed above.

Fourth Embodiment

In place of the ejector 16 of the ejector refrigeration cycle 10 of the first embodiment, an ejector 26 is provided in a fourth embodiment of the present invention. The constituent devices of the ejector refrigeration cycle 10 of the present embodiment are similar to those of the first embodiment, and the functions of the ejector 26 of the present embodiment are similar to those of the ejector 16 of the first embodiment. Therefore, the operation of the ejector refrigeration cycle 10 of the present embodiment is substantially the same as that of the first embodiment.

Figure 6:
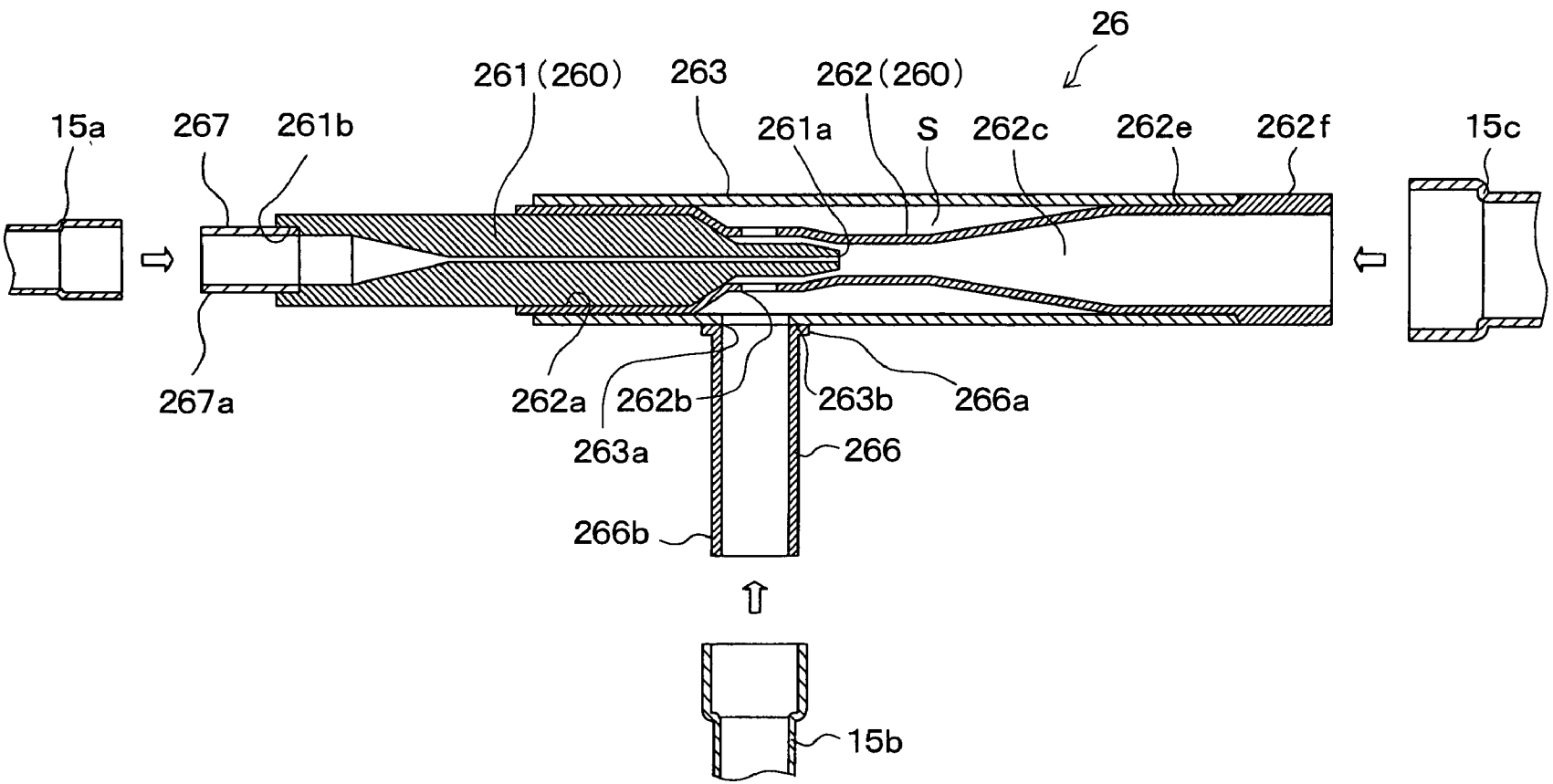
FIG. 6 is a cross-sectional view of an ejector according to a fourth embodiment of the present invention.

Now, the structure of the ejector 26 will be described in detail with reference to FIG. 6. FIG. 6 is an axial cross-sectional view of the ejector 26 of the present embodiment. The ejector 26 includes an ejector functional unit 260 and a cover (housing) 263. The ejector functional unit 260 includes a nozzle 261 and a body 262, which are connected together. The cover 263 is configured into a generally cylindrical tubular form and receives a portion of the ejector functional unit 260.

The nozzle 261 is made of the stainless alloy and is configured into a generally cylindrical tubular form. The basic structure of the nozzle 261 is the same as that of the nozzle 161 of the first embodiment. Therefore, a refrigerant discharge opening 261*a* is also formed in the nozzle 261 of the present embodiment to discharge the depressurized refrigerant therethrough.

Furthermore, a joint surface 261*b* is formed in an inner peripheral wall surface of the other end portion of the nozzle 261, which is opposite from the refrigerant discharge opening 261*a*, i.e., the inner peripheral wall surface of the upstream end portion of the nozzle 261, which is located on the upstream side in the refrigerant flow direction. A nozzle side pipe 267, which conducts the refrigerant (fluid) to be supplied from the first refrigerant pipe 15*a* into the nozzle 261, is connected to the joint surface 261*b* of the nozzle 261.

The nozzle side pipe 267 is a pipe made of copper. A nozzle side connecting portion 267*a* is formed in an outer peripheral wall surface of an upstream side portion of the nozzle side pipe 267 and is connected with the first refrigerant pipe 15*a*, which serves as the nozzle side external device. More specifically, the nozzle side connecting portion 267*a* is a portion of the nozzle side pipe 267, which forms a brazing joint surface that is joined to the first refrigerant pipe 15*a* by brazing.

The body 262 is made of the stainless alloy and is configured into a generally cylindrical tubular form. The basic structure of the body 262 is substantially the same as that of the body 162 of the first embodiment. Therefore, a fixing portion 262*a*, a refrigerant suction openings (fluid suction openings) 262*b* and a distal end portion (downstream end portion) 262*e* are also formed in the body 262 of the present embodiment in a manner similar to those of the body 162 of the first embodiment.

An inner peripheral wall surface of the fixing portion 262*a* of the present embodiment does not merely serve as a wall surface, to which the nozzle 261 is press fitted and is fixed. Rather, the inner peripheral wall surface of the fixing portion 262*a* serves as a brazing joint surface, to which the nozzle 261 is connected by brazing. Similarly, an outer peripheral wall surface of the distal end portion 262*e* serves as a brazing joint surface, to which the inner peripheral wall surface of the cover 263 is connected by brazing.

Furthermore, a pressurizing portion 262*c* is formed in the body 262 of the present embodiment to implement both of the function of the mixing portion 162*c* and the function of the diffuser portion 162*d* of the first embodiment. In the pressurizing portion 262*c*, the refrigerant discharged from the refrigerant discharge opening 261*a* of the nozzle 261 is mixed with the refrigerant drawn through the refrigerant suction opening 262*b* while the pressure of the mixed refrigerant (refrigerant mixture) is increased.

More specifically, as shown in FIG. 6, the inner diameter of the body 262 at the pressurizing portion 262*c* is progressively increased toward the downstream side in the refrigerant flow direction. Furthermore, the degree of increase in the inner diameter of the body 262 at the pressurizing portion 262*c* is smoothly changed such that the degree of increase in the inner diameter of the body 262 at the pressurizing portion 262*c* is relatively small in the upstream side region and the downstream side region at the pressurizing portion 262*c* and is relatively large in the intermediate region between the upstream side region and the downstream side region.

Figure 7:
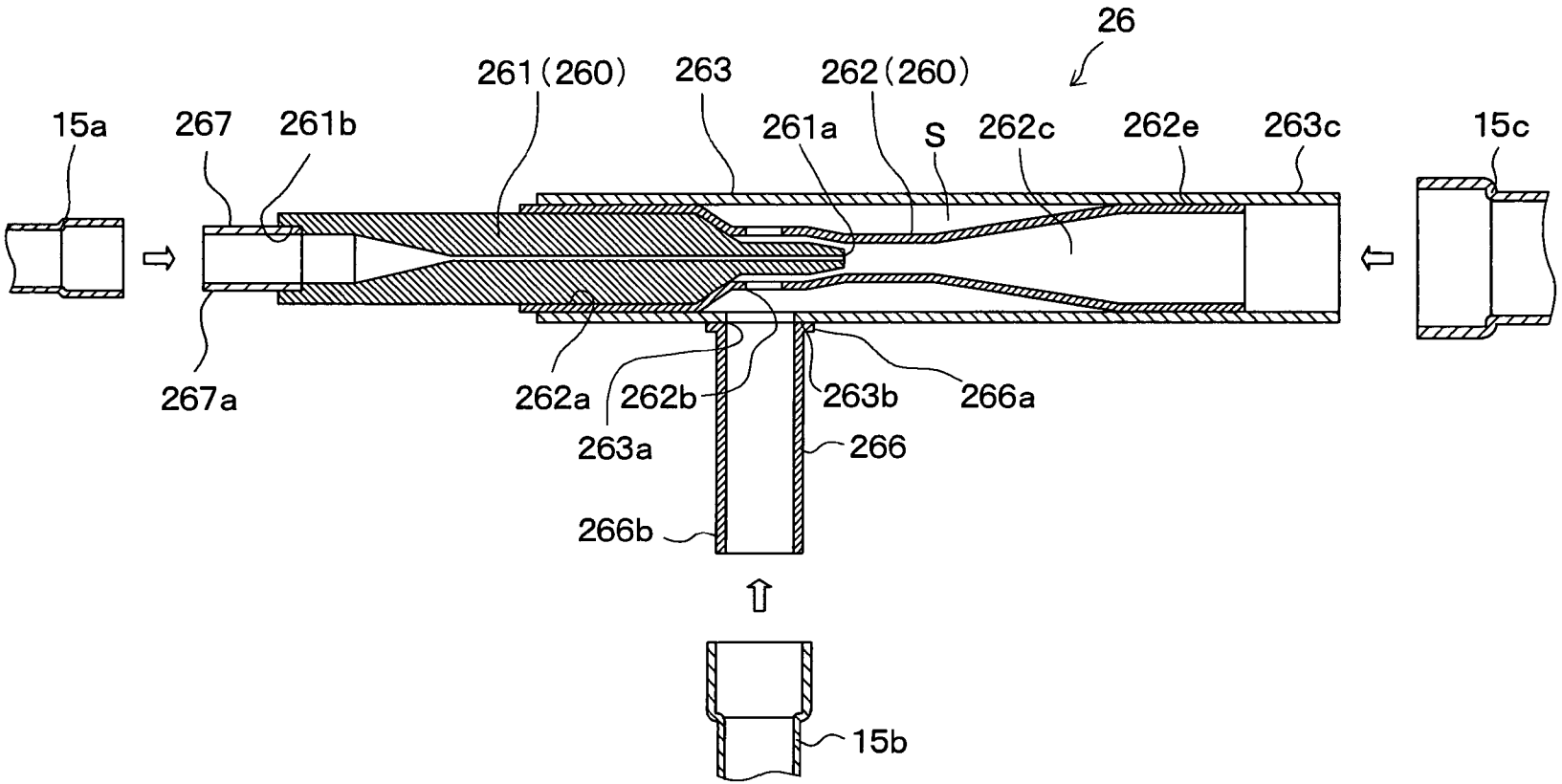
FIG. 7 is an enlarged cross-sectional view of an ejector according to a fifth embodiment of the present invention.

Therefore, a line, along which the axial cross section of FIG. 7 and the inner peripheral wall surface of the pressurizing portion 262*c* intersect with each other, is convex in a direction toward the axis of the ejector 26 in an area, which is from the upstream side region to the intermediate region of the pressurizing portion 262*c*, and is convex in a direction away from the axis of the ejector 26 in an area, which is from the intermediate region to the downstream side region of the pressurizing portion 262*c*.

Thereby, in the pressurizing portion 262*c*, the refrigerant discharged from the refrigerant discharge opening 261*a* of the nozzle 261 and the refrigerant drawn through the refrigerant suction opening 262*b* are mixed while the flow of the mixed refrigerant is decelerated to increase the refrigerant pressure. That is, the pressurizing portion 262*c* converts the velocity energy of the refrigerant into the pressure energy of the refrigerant. The outer diameter of the body 262 changes in response to the change in the inner diameter of the body 262.

Furthermore, a pressurizing portion side connecting portion 262*f*, which is connected to the third refrigerant pipe (serving as the pressurizing portion side external device) 15*c*, is formed at the downstream side portion of the pressurizing portion 262*c* of the body 262. More specifically, the outer peripheral wall surface of the pressurizing portion side connecting portion 262*f* serves as the brazing joint surface, which is connected to the third refrigerant pipe 15*c* by brazing.

The portion of the nozzle 261, which is located on the refrigerant discharge opening 261*a* of the nozzle 261, is inserted into and is connected to the fixing portion 262*a* of the body 262 to form the ejector functional unit 260. Therefore, upon completion of the assembling of the ejector functional unit 260, the other end portion (upstream end portion) of the nozzle 261, which is opposite from the one end portion (downstream end portion) of the nozzle 261 that is received into the body 262 of the nozzle 261, axially projects outwardly from the body 262.

The cover 263 is made of copper and is configured into a generally cylindrical tubular form. The cover 263 may be formed by drilling a hole in a refrigerant pipe. Furthermore, as shown in FIG. 6, the cover 263 of the present embodiment receives the portion of the body 262 of the ejector functional unit 260. In other words, the end portion (upstream end portion) of the body 262, into which the nozzle 261 is inserted, and the pressurizing portion side connecting portion 262*f* are not received in the cover 263 and axially protrude outwardly from the cover 263.

Furthermore, the inner peripheral wall surface of the cover 263 is joined to the outer peripheral wall surface of the fixing portion 262*a* and the outer peripheral wall surface of the distal end portion (downstream end portion) 262*e* of the body 262 of the ejector functional unit 260, and the annular space S is formed between the inner peripheral wall surface of the cover 263 and the outer peripheral wall surface of the ejector functional unit 260 (more specifically, the body 262).

A cover side opening (housing side opening) 263*a* radially extends through the cylindrical tubular wall of the cover 263 to communicate between the interior and the exterior of the cover 263, so that the refrigerant suction openings 262*b* of the ejector functional unit 260 are communicated with the cover side opening 263*a* of the cover 263. Furthermore, a cover side connecting portion (housing side connecting portion) 263*b* is provided along a peripheral edge portion of the cover side opening 263*a* in the outer peripheral wall surface of the cover 263 and is connected to, i.e., joined to the suction opening side pipe 266.

The suction opening side pipe 266 is made of copper and has a pipe side connecting portion 266*a*, which is connected to the cover side connecting portion 263*b*, at a downstream end portion of the suction opening side pipe 266. Furthermore, a suction opening side connecting portion 266*b*, which is connected to the second refrigerant pipe (serving as the suction opening side external device) 15*b*, is provided in the outer peripheral wall surface of the suction opening side pipe 266 at an upstream end portion of the suction opening side pipe 266.

That is, the cover side opening 263*a* of the present embodiment is connected to the second refrigerant pipe 15*b*, which conducts the refrigerant (fluid) that is drawn into the refrigerant suction openings 262*b*, through the suction opening side pipe 266. In the present embodiment, the first to third refrigerant pipes 15*a*-15*c* are formed as the copper tubes.

Next, the manufacturing method of the ejector 26 of the present embodiment will be described. First, a nozzle inserting process is executed such that the refrigerant discharge opening 261*a* side end portion (downstream end portion) of the nozzle 261 is inserted into the interior of the body 262 to temporarily fix between the body 262 and the nozzle 261. In the nozzle inserting process, there is provided the ejector functional unit 260 in a temporal form (a sub-assembly form) before execution of the joining between the body 262 and the nozzle 261 by the brazing.

Then, a body inserting process is executed such that the body 262 of the ejector functional unit 260 in the temporal form is inserted into the interior of the cover 263 to temporarily fix between the cover 263 and the ejector functional unit 260 in the temporal form. In the body inserting process, there is provided the ejector 26 in a temporal state, which is before the execution of the joining between the ejector functional unit 260 in the temporal state and the cover 263.

Specifically, in the body inserting process, the nozzle 261 side portion (upstream side portion) of the ejector functional unit 260 in the temporal form is inserted into the downstream end portion of the cover 263. At this time, the nozzle 261 side end portion (upstream end portion) and the pressurizing portion side connecting portion (downstream end portion) 262*f* of the body 262 project outwardly from the cover 263 in the axial direction of the ejector 26. Furthermore, in the body inserting process, the body 262 of the ejector functional unit 260 in the temporal form is inserted into the interior of the cover 263 such that the refrigerant suction openings 262*b* communicate with the cover side opening 263*a* of the cover 263, i.e., are radially aligned with the cover side opening 263*a* of the cover 263.

Then, the pipe side connecting portion (downstream end connecting portion) 266*a* of the suction opening side pipe 266 is placed into contact with and is temporarily fixed to the cover side connecting portion 263*b*, which is formed in the cover 263 of the ejector 26 in the temporal form. Furthermore, the nozzle side pipe 267 is inserted to the joint surface 261*b*, which is formed in the nozzle 261, so that the nozzle 261 and the nozzle side pipe 267 are temporarily fixed.

Furthermore, an ejector joining process is executed such that the ejector 26 in the temporarily fixed state, in which the suction opening side pipe 266 and the nozzle side pipe 267 are temporarily fixed, is placed into a heating furnace to simultaneously and integrally join the nozzle 261, the body 262, the cover 263 and the nozzle side pipe 267 by brazing.

Specifically, in the ejector joining process, the brazing material, which has been previously cladded over the outer surface of the nozzle 261, the outer surface of the body 262, the outer surface of the cover 263, the outer surface of the suction opening side pipe 266 and the outer surface of the nozzle side pipe 267 of the ejector 26 in the temporarily fixed state, is melted. Then, the ejector 26 is cooled until the brazing material is solidified once again. In this way, the nozzle 261, the body 262, the cover 263, the suction opening side pipe 266 and the nozzle side pipe 267 are simultaneously and integrally joined by the brazing to form the ejector 26.

Furthermore, at the time of connecting the thus formed ejector 26 to the rest of the ejector refrigeration cycle 10, the first refrigerant pipe 15*a* is connected to the nozzle side connecting portion 267*a* of the nozzle side pipe 267, and the second refrigerant pipe 15*b* is connected to the suction opening side connecting portion 266*b* of the suction opening side pipe 266. Also, the third refrigerant pipe 15*c* is connected to the pressurizing portion side connecting portion 262*f* of the body 262.

Then, these connecting portions 267*a*, 266*b*, 262*f* are joined to the refrigerant pipes, i.e., the external devices 15*a*-15*c* by torch brazing. Here, according to the present embodiment, at the time of connecting the ejector 26 to the ejector refrigeration cycle 10, the brazing is solely used for executing the joining without using a mechanical fastening means (e.g., the unions).

In the present embodiment, the nozzle 261 is made of the stainless alloy, and the body 262 is made of the stainless alloy. Furthermore, the cover 263, the suction opening side pipe 266 and the nozzle side pipe 267 are made of copper. Thereby, according to the present embodiment, the connections, which are joined in the ejector joining process, include the stainless alloy to stainless alloy brazing connection, the stainless alloy to copper brazing connection and the copper to copper brazing connection.

Therefore, in the ejector joining process, a silver brazing material (silver brazing alloy) is used as the brazing material. The silver brazing material includes silver, copper and zinc as its main components and is suitable for the metal to metal brazing. Therefore, in the single ejector joining process (simultaneous ejector joining process), the nozzle 261, the body 262, the cover 263, the suction opening side pipe 266 and the nozzle side pipe 267 are simultaneously and integrally joined.

Furthermore, at the time of connecting the ejector 26 to the other devices of the ejector refrigeration cycle 10, the torch brazing is used. Therefore, it is possible to use the appropriate brazing material, which is appropriate for the corresponding brazing connection. For example, at the time of connecting the first refrigerant pipe 15*a* to the nozzle side pipe 267 and the time of connecting the second refrigerant pipe 15*b* to the suction opening side pipe 266, the copper to copper brazing-connection is formed. Therefore, the copper brazing material (copper brazing alloy) can be used.

The copper brazing material includes copper and zinc as its main components and is suitable for the copper to copper brazing. Furthermore, it should be noted that the torch brazing uses a gas flame to partially heat the brazing connection of the brazing subject product without heating the entire brazing subject product unlike the heating furnace.

In the present embodiment, the ejector 26, which is manufactured in the above described manner, is used, so that the advantages described below can be implemented.

First of all, in the case of the ejector 26 of the present embodiment, the second refrigerant pipe (the suction opening side external device) 15*b* is connected to the cover 263, which receives at least the portion of the ejector functional unit 260, through the suction opening side pipe 266. Therefore, the entire specification of the ejector 26 can be changed by changing the specification of the ejector functional unit 260 without changing the shape of the suction opening side connecting portion 266*b*, which is provided in the suction opening side pipe 266. Therefore, it is possible to improve the installability of the ejector 26 to the second refrigerant pipe 15*b*.

In addition, the nozzle side connecting portion 267*a* is provided in the nozzle side pipe 267. Therefore, it is possible to improve the installability of the ejector 26 to the first refrigerant pipe (the nozzle side external device) 15*a*. Furthermore, the pressurizing portion side connecting portion 262*f* is provided in the body 262. Therefore, it is possible to improve the installability of the ejector 26 to the third refrigerant pipe (the pressurizing portion side external device) 15*c*.

Furthermore, the nozzle 261 and the body 262 are connected together to form the ejector functional unit 260. Therefore, the specification of the nozzle 261 and the specification of the body 262 can be changed independently. As a result, the change in the entire specification of the ejector 26 can be easily made, and the installability of the ejector 26 to the external devices can be improved.

Also, the annular space S is formed between the outer peripheral surface of the ejector functional unit 260 (specifically, the body 262) and the inner peripheral surface of the cover 263. Therefore, it is possible to reduce the weight of the ejector. Furthermore, due to the thermal insulating function of this annular space S, it is possible to limit the evaporation of the liquid phase refrigerant in the interior of the body 262 at the time of operating the ejector refrigeration cycle 10. Therefore, the cooling capacity at the first evaporator 17 can be improved.

Furthermore, in the present embodiment, the portion of the nozzle 261, which is placed at the radially innermost location in the ejector 26, projects axially outwardly. Also, the nozzle 261 side end portion of the body 262 and the pressurizing portion side connecting portion 262*f* of the body 262 project axially outwardly from the cover 263. Therefore, the connection between the nozzle 261 and the body 262 and the connection between the body 262 and the cover 263 can be visually observed from the outside of the ejector 26.

Therefore, it is possible to check whether a connection failure (a joining failure) exists at the connection between the nozzle 261 and the body 262, the connection between the body 262 and the cover 263 and the connections between the respective refrigerant pipes 15*a*-15*c* and the ejector 26 through use of, for example, a pressurizing means, which closes two of the first to third refrigerant pipes 15*a*-15*c* and pressurizes the interior of the ejector 26 through the remaining one of the first to third refrigerant pipes 15*a*-15*c*.

Also, in the present embodiment, the shape of the pressurizing portion 262*c* is set such that the inner diameter (the refrigerant passage cross-sectional area) of the pressurizing portion 262*c* smoothly changes. Therefore, even when the thermal deformation of the nozzle 261 and the body 262 occurs in the ejector joining process, it is possible to limit the deterioration of the performance of the ejector 26.

That is, in a case where a steeply changed portion (like in the boundary between the mixing portion 162*c* and the diffuser portion 162*d*), in which the refrigerant passage cross-sectional area steeply changes, exists on the downstream side of the refrigerant discharge opening 261*a* of the nozzle 261 in the interior space of the body 262, when the discharging direction (the jet direction) of the refrigerant discharged from the nozzle 261 is slightly deviated from the axis of the ejector 26 due to the thermal deformation, the undesirable velocity distribution is created in the refrigerant flow, which is supplied to the diffuser portion 162*d*.

In contrast, at the pressurizing portion 262*c* of the present embodiment, the shape of the pressurizing portion 262*c* is designed such that the refrigerant passage cross-sectional area of the pressurizing portion 262*c* smoothly changes. Therefore, the unbalance of the refrigerant flow less likely occurs in the pressurizing portion 262*c*. As a result, it is possible to limit the deterioration of the performance of the ejector 26.

Here, even in the case where the pressurizing portion 262*c* of the present embodiment is used, it is desirable to minimize the thermal deformation of the nozzle 261 and the body 262. Particularly, it is desirable to limit the thermal deformation of the refrigerant discharge opening 261*a* in order to limit the deviation of the discharging direction (the jet direction) of the refrigerant from the axis of the ejector 26.

In view of this, according to the present embodiment, the second refrigerant pipe 15*b* is connected to the cover side connecting portion 263*b* of the cover 263 through the suction opening side pipe 266, and the first refrigerant pipe 15*a* is connected to the nozzle 261 through the nozzle side pipe 267. Furthermore, the third refrigerant pipe 15*c* is connected to the pressurizing portion side connecting portion 262*f* of the body 262. Therefore, the sufficient distance can be provided between each heat applied portion, which is heated by the torch brazing, and the refrigerant discharge opening 261*a*. Thereby, the thermal deformation of the refrigerant discharge opening 261*a* can be limited.

Fifth Embodiment

In a fifth embodiment, a modification of the ejector 26 of the fourth embodiment will be described. As shown in FIG. 7, in the ejector 26 of the present embodiment, the pressurizing portion side connecting portion 262*f* of the body 262 is eliminated, and the pressurizing portion 262*c* side end portion (downstream end portion) of the body 262 is received in the cover 263.

Furthermore, a pressurizing portion side connecting portion (downstream end connecting portion) 263*c* is provided in the pressurizing portion 262*c* side end portion (downstream end portion) of the cover 263 to connect with the third refrigerant pipe 15*c*. More specifically, the pressurizing portion side connecting portion 263*c* is provided in the outer peripheral wall surface of the downstream end portion of the cover 263 to serve as a brazing joint surface, which is connected to the third refrigerant pipe 15*c* by brazing.

The remaining structure and manufacturing method of the ejector 26 are similar to those of the fourth embodiment. Thus, the ejector 26 of the present embodiment can provide advantages similar to those of the fourth embodiment. That is, the change in the entire specification of the ejector 26 can be easily made, and the installability of the ejector 26 to the external devices can be improved.

Furthermore, in the present embodiment, the pressurizing portion side connecting portion 263*c* is formed in the copper cover 263. Therefore, the connection between the first refrigerant pipe 15*a* and the nozzle side connecting portion 267*a* of the nozzle side pipe 267, the connection between the second refrigerant pipe 15*b* and the cover side connecting portion 263*b* of the cover 263, and the connection between the third refrigerant pipe 15*c* and the pressurizing portion side connecting portion 263*c* of the cover 263 can be brazed by the copper to copper brazing.

Therefore, at the time of connecting the ejector 26 to the other devices of the ejector refrigeration cycle 10, it is possible to make the connection only by executing the torch brazing using the copper brazing material (the copper brazing alloy). Thereby, the ejector can be easily connected to the other devices of the ejector refrigeration cycle by the single torch brazing facility without requiring two torch brazing facilities in the case where the two different brazing materials, which have different melting points, are used in the brazing of the corresponding connection.

As a result, the installability of the ejector 26 to the ejector refrigeration cycle can be further improved. Also, only the single torch brazing facility is used to connect the ejector 26 to the ejector refrigeration cycle 10, and it is not required to use the multiple torch brazing facilities, the number of which correspond to the number of types of brazing materials used in the brazing. Therefore, the manufacturing costs of the ejector 26 can be reduced.

Furthermore, the pressurizing portion side connecting portion 263*c* is provided in the cover 263, which does not directly contact the nozzle 261, so that the thermal deformation of the refrigerant discharge opening 261*a* can be further effectively limited at the time of the torch brazing.

The above embodiments may be modified as follows.

Figure 8:
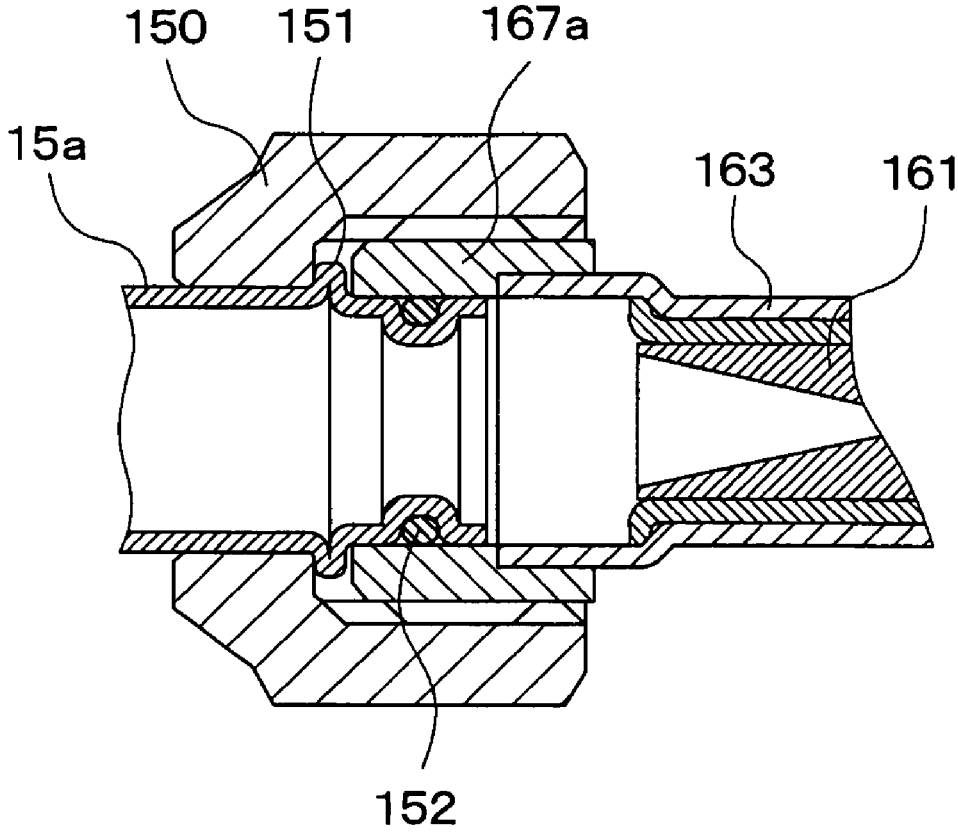
FIG. 8 is an enlarged partial cross-sectional view showing a modification of the connection between the ejector and the external device of the first embodiment.

(1) In the first embodiment, the O-ring 152 is interposed between the first union 167*a* and the removal limiting portion 151. However, the location of the O-ring 152 is not limited to this location. For example, as shown in FIG. 8, an annular receiving groove, which receives the O-ring 152, may be formed in the outer peripheral wall surface of the first refrigerant pipe 15*a* to interpose the O-ring 152 between the first union 167*a* and the first refrigerant pipe 15*a*.

(2) In the first to third embodiments, the connecting portions of the first and second covers 163, 164 and the suction opening side connecting portion of the suction opening side pipe 166 are similarly constructed. Alternatively, the connecting portions of the first and second covers 163, 164 and the suction opening side connecting portion of the suction opening side pipe 166 may be formed differently. For example, a union may be provided to form the connecting portion of the first cover 163 like in the first embodiment and a flange may be provided to form the connecting portion of the second cover 164 like in the second embodiment.

That is, the connecting portions of the first and second covers 163, 164 and the suction opening side connecting portion of the suction opening side pipe 166 may, be appropriately configured depending on the connecting structure thereof, which is connected to the corresponding external device. Thus, in the case where the connecting method, such as welding or bonding, is used at the connection to the external device, the connection does not need to be constructed from the fastening member that is mechanically fastened. Furthermore, in the case where the external device can be directly connected to the third opening 165*c* of the block 165, it is possible to eliminate the suction opening side pipe 166.

(3) In the housing forming process of the first to third embodiments, the first and second covers 163, 164 are connected to the block 165 by brazing. Alternatively, the first and second covers 163, 164 may be connected to the block 165 by, for example, bonding, welding or the like.

(4) In the fixing process of the first to third embodiments, the non-thermal fixing means is used as the fixing means, so that the nozzle 161 side of the ejector functional unit 160 is securely press fitted into the first cover 163. Alternatively, any other appropriate fixing means may be used. For example, as the non-thermal fixing means, another fixing means, such as swaging, bonding, may be used. Further alternatively, as another fixing means, screw threads may be formed in the outer peripheral surface of the ejector functional unit 160 and in the inner peripheral surface of the housing 170 to threadably fix therebetween.

Furthermore, as long as the thermal deformation does not occur in the ejector functional unit 160, it is possible to use the fixing means, which involves the heating. Specifically, spot welding may be used to implement the fixing.

Figure 9:
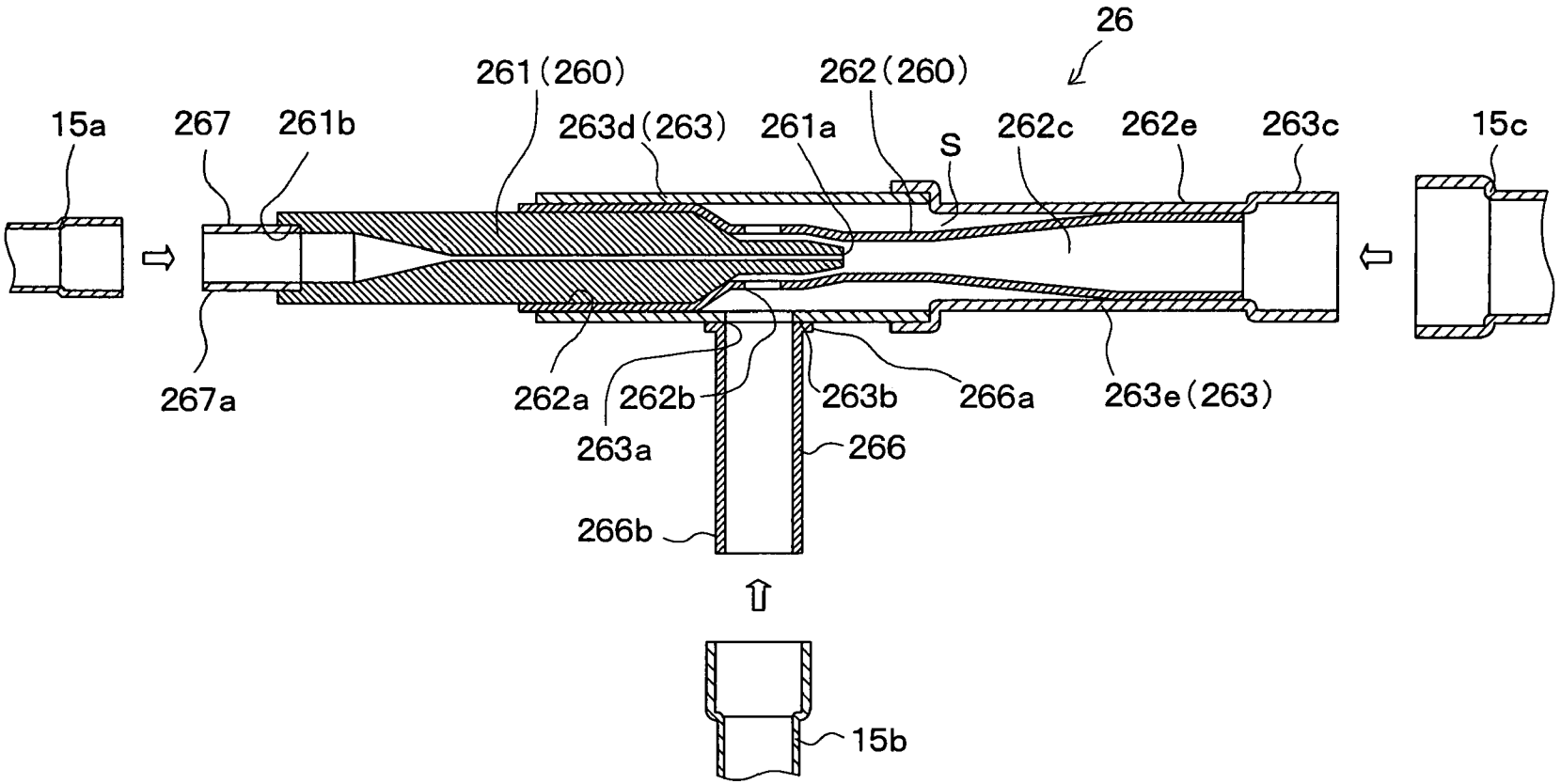
FIG. 9 is a cross-sectional view showing a modification of the ejector of the fifth embodiment.

(5) In the fourth and fifth embodiments, the single pipe member is used as the cover 263. However, the cover 263 is not limited to this. For example, as shown in FIG. 9, multiple pipe members may be combined to form the cover (housing) 263. In this way, the appropriate cover 263, which conforms with the shapes of the nozzle 261 and the body 262 (the ejector functional unit 260) can be easily made.

Furthermore, in the exemplary case of FIG. 9, the portion of the body 262, which forms the pressurizing portion 262*c*, has the outer diameter smaller than that of the fifth embodiment. In view of this, the nozzle side cover member 263*d* and the pressurizing portion side cover member 263*e* are combined to form the cover 263 in such a manner that the pressurizing portion side cover member 263*e* has the pipe outer diameter smaller than that of the nozzle side cover member 263*d*.

(6) In the fourth and fifth embodiments, the body inserting process is executed after the nozzle inserting process. However, the execution order of the body inserting process and the nozzle inserting process are not limited to this order. For example, the body 262 may be inserted into the cover 263, and then the nozzle 261 may be inserted into the body 262 received in the cover 263.

Furthermore, at the time of connecting the ejector 26 to the ejector refrigeration cycle 10, if it is possible to have the multiple torch brazing facilities, or if the thermal deformation of the refrigerant discharge opening 261*a* of the nozzle 261 does not cause any trouble, the nozzle side pipe 267 may be eliminated, and the first refrigerant pipe 15*a* may be directly connected to the joint surface 261*b* of the nozzle 261 by brazing. Furthermore, the suction opening side pipe 266 may be eliminated, and the second refrigerant pipe 15*b* may be directly connected to the cover side connecting portion 263*b* of the cover 263 by brazing.

Also, at the time of connecting the ejector 26 to the other devices of the ejector refrigeration cycle 10, the other means, such as the spot welding, bonding, may be used without executing the torch brazing.

(7) In each of the above embodiments, the ordinary chlorofluorocarbon refrigerant is used as the refrigerant. However, the type of the refrigerant is not limited to this. For example, hydrocarbon refrigerant or carbon dioxide may be used as the refrigerant of the above embodiments. Furthermore, the ejector of the present invention may be applied to a supercritical refrigeration cycle, in which the high pressure side refrigerant pressure exceeds the critical pressure.

(8) In each of the above embodiments, the ejector refrigeration cycle 10, which includes the ejector 16, 26 of the above embodiment, is applied to the vehicle air conditioning system. However, the application of the present invention is not limited to this. For example, the ejector refrigeration cycle 10 may be applied to the stationary refrigeration cycle. Also, the application of the ejector 16 of the present invention is not limited to the refrigeration cycle.

Sixth Embodiment

Figure 10:
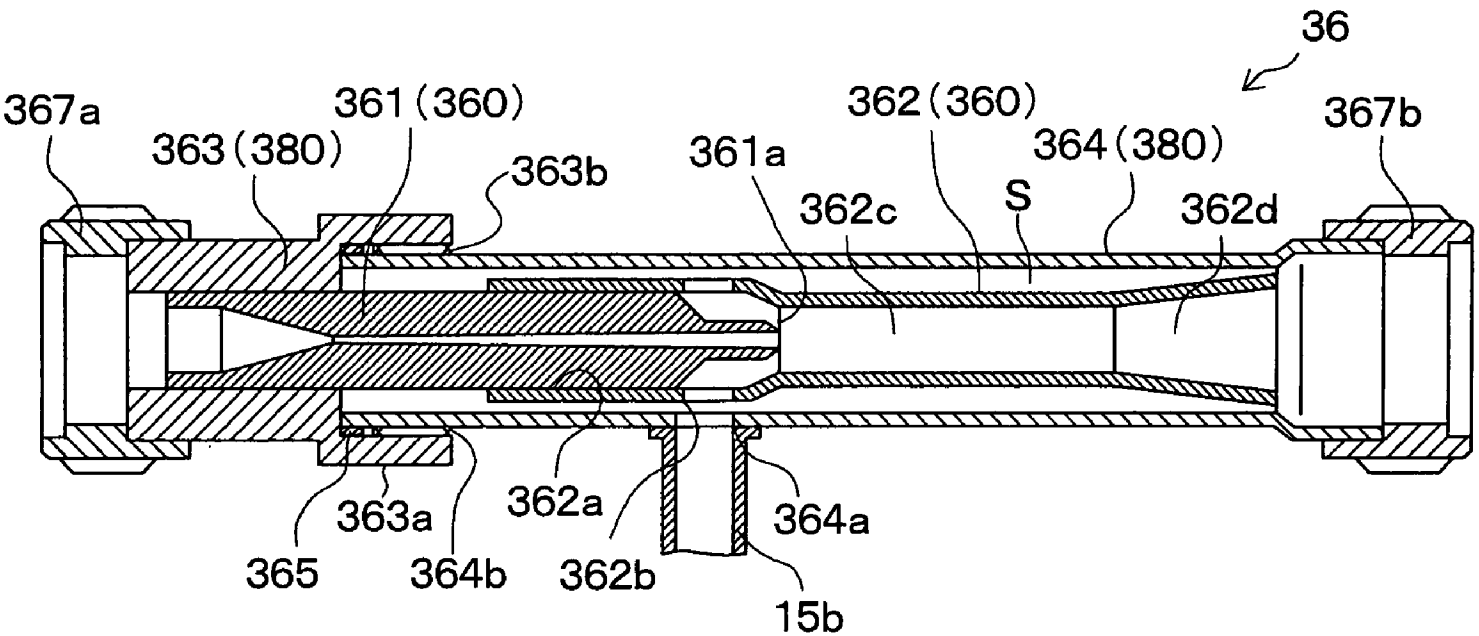
FIG. 10 is an enlarged cross-sectional view of an ejector, of an ejector refrigeration cycle according to a sixth embodiment of the present invention.

A sixth embodiment of the present invention will be described with reference to FIGS. 10 and 11. The present embodiment is a modification of the first embodiment. Specifically, the ejector 16 of the first embodiment is replaced with an ejector 36 discussed below.

The ejector 36 of the present embodiment includes an ejector functional unit 360, a first cover 363 and a second cover 364. The ejector functional unit 360 includes a nozzle 361 and a body 362, which are integrally connected together, i.e., are integrally joined together. The first cover 363 and the second cover 364 are connected together to form a housing 380 and receive the ejector functional unit 360.

The nozzle 361 is made of metal (e.g., brass or stainless alloy) and is configured into a generally cylindrical tubular form. In the nozzle 361, a cross-sectional area of a refrigerant passage, to which the refrigerant is supplied from the first refrigerant pipe 15*a*, is narrowed to isenthalpically depressurize and expand the refrigerant. In the present embodiment, the nozzle 361 is a Laval nozzle that has a throat, at which the cross-sectional area of the refrigerant passage is minimized. Here, it should be noted that the nozzle 361 may be alternatively formed as a convergent nozzle.

The body 362 is a tubular member, which is made of metal (e.g., aluminum) and is configured into a generally cylindrical tubular form. The body 362 includes a fixing portion 362*a*, refrigerant suction openings (fluid suction openings) 362*b*, a mixing portion 362*c* and a diffuser portion 362*d*, which are arranged in this order one after another in a flow direction (a refrigerant flow direction) of the refrigerant. Furthermore, an inner diameter of the body 362 changes along its length in conformity with the functions of the above-described portions 362*a*-362*d* of the body 362.

The fixing portion 362*a* is a supporting and fixing portion, into which the nozzle 361 is press fitted. Therefore, the inner diameter of the body 362 at the fixing portion 362*a* is slightly smaller than an outer diameter of the nozzle 361. When the nozzle 361 is press fitted into and is secured to the fixing portion 362*a*, the nozzle 361 and the body 362 are connected together to form the ejector functional unit 360.

Each refrigerant suction opening 362*b* is formed as a through hole, which radially extends through the wall of the body 362 to communicate between the outside and the inside of the body 362. Furthermore, the refrigerant suction openings 362*b* of the body 362 are communicated with a refrigerant discharge opening 361*a* of the nozzle 361. The refrigerant, which is discharged from the second evaporator 19, is drawn into the interior of the body 362 through the refrigerant suction openings 362*b*. An inner diameter of a portion of the body 362, which extends from the refrigerant suction openings 362*b* to the mixing portion 362*c*, is progressively reduced toward the downstream side (the right side in FIG. 10) to conform with a shape of a distal end portion (a downstream end portion) of the nozzle 361.

The mixing portion 362*c* forms a mixing space (a mixing chamber), in which the refrigerant discharged from the refrigerant discharge opening 361*a* of the nozzle 361 is mixed with the refrigerant drawn through the refrigerant suction openings 362*b* to form the refrigerant mixture. The inner diameter of the body 362 in the mixing portion 362*c* is generally constant along its length.

The inner diameter of the body 362 at the diffuser portion 362*d* is progressively increased toward the downstream side, and thereby the cross-sectional area of the refrigerant passage of the diffuser portion 362*d* is also progressively increased toward the downstream side. In this way, the diffuser portion 362*d* reduces the velocity of the refrigerant flow to increase the refrigerant pressure. That is, the diffuser portion 362*d* converts the velocity energy of the refrigerant into the pressure energy of the refrigerant. The outer diameter of the body 362 changes in response to the change in the inner diameter of the body 362.

The first cover 363 and the second cover 364 are formed as generally cylindrical tubular members made of metal (e.g., aluminum or copper). Alternatively, the first cover 363 and the second cover 364 may be refrigerant pipes, on which a pipe expanding process and/or a hole forming process are performed. In the state where the ejector functional unit 360 is received in the first cover 363 and the second cover 364, the first cover 363 receives the nozzle 361 side portion of the ejector functional unit 360 (the upstream side portion of the ejector functional unit 360, at which the nozzle 361 is located).

At this time, the outer peripheral wall surface of the nozzle 361 of the ejector functional unit 360 is securely press fitted into the inner peripheral wall surface of the first cover 363, so that the outer peripheral wall surface of the nozzle 361 and the inner peripheral wall surface of the first cover 363 contact with each other without forming a gap therebetween. Therefore, the refrigerant will not leak to the outside through the connection between the inner peripheral wall surface of the first cover 363 and the outer peripheral wall surface of the ejector functional unit 360.

A second cover 364 side end portion (downstream end portion) of the first cover 363 has an expanded pipe portion 363*a*, which has an inner diameter larger than an outer diameter of the outer peripheral wall surface of the ejector functional unit 360. A first screw thread 363*b* is formed in the inner peripheral wall surface of the expanded pipe portion 363*a* and is threadably engaged with a second screw thread 364*b*, which is formed in an outer peripheral wall surface of the second cover 364.

The second cover 364 receives an intermediate portion (a portion around the refrigerant suction openings 362*b*) to a body 362 side portion of the ejector functional unit 360 (i.e., receives the downstream side portion of the ejector functional unit 360). That is, the second cover 364 receives the remaining portion of the ejector functional unit 360, which is other than the received portion (the upstream side portion) of the ejector functional unit 360 that is received in the first cover 363.

At this time, an annular space S is formed between the inner peripheral wall surface of the second cover 364 and the outer peripheral wall surface of the ejector functional unit 360 (specifically, the body 362). The second cover 364 is fixed to the first cover 363 without contacting the entire ejector functional unit 360, i.e., without contacting any part of the ejector functional unit 360.

Specifically, as discussed above, the outer peripheral wall surface of the first cover 363 side end portion of the second cover 364 has the second screw thread 364*b*, which is threadably engaged with the first screw thread 363*b*. When the first screw thread 363*b* and the second screw thread 364*b* are threadably engaged with each other and are tightened with each other, the first cover 363 and the second cover 364 are connected together and are secured together.

An O-ring 365 is interposed between the first cover 363 and the second cover 364 to limit leakage of the refrigerant to the outside through a gap between the first cover 363 and the second cover 364.

Furthermore, a through hole (a cover side opening, i.e., housing side opening) 364*a* radially extends through a cylindrical tubular wall of the second cover 364 to communicate between the interior and the exterior of the second cover 364. The through hole 364*a* is positioned to communicate with the refrigerant suction openings 362*b* of the ejector functional unit 360. The second refrigerant pipe 15*b* is joined to the through hole 364*a* by a joining means (e.g., spot welding).

First and second unions (fastening members) 367*a*, 367*b* are respectively provided at the other end portion (upstream end portion) of the first cover 363 and the other end portion (downstream end portion) of the second cover 364. The first and second unions 367*a*, 367*b* form connecting portions, which are connected to the other constituent devices (external devices) of the ejector refrigeration cycle 10.

Alternatively, the first and second unions 367*a*, 367*b* may be joined to the other end portions, respectively, of the first cover 363 and of the second cover 364 by any other joining means, such as brazing, welding or bonding. Further alternatively, the first and second unions 367*a*, 367*b* may be directly formed at the other end portions, respectively, of the first cover 363 and of the second cover 364.

Figure 11:
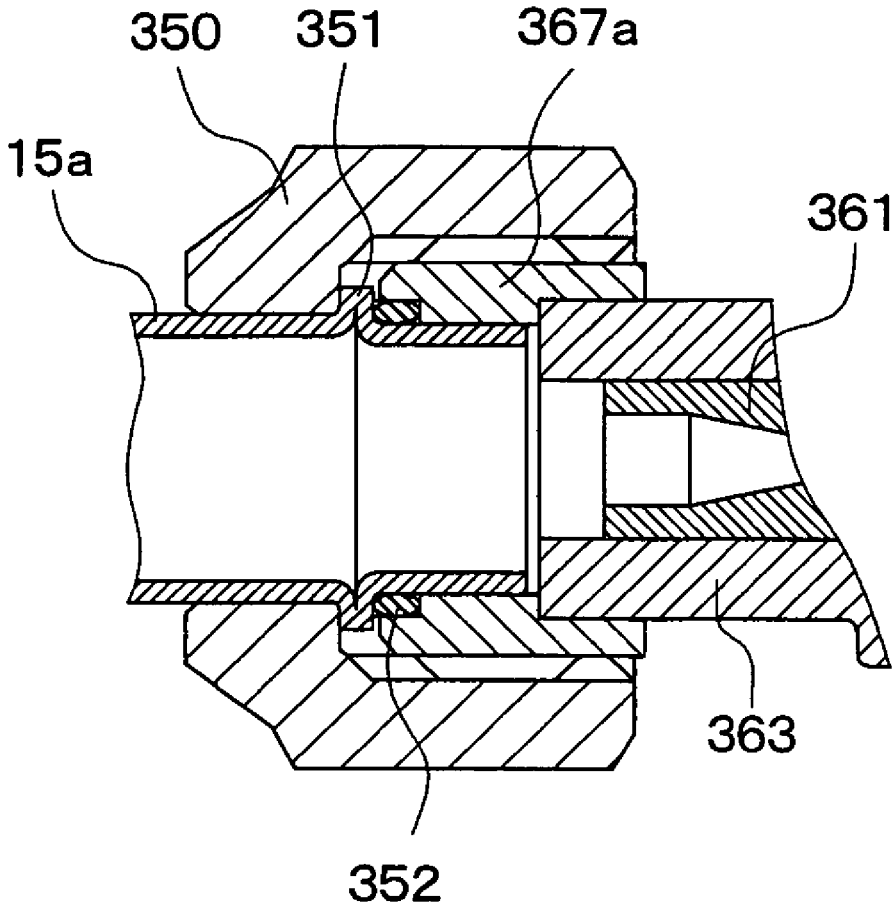
FIG. 11 is an enlarged partial cross-sectional view of the ejector of the sixth embodiment.

Now, with reference to FIG. 11, the connection between each of the above-described external devices and the corresponding union will be specifically described in view of the exemplary case of the first union 367*a*, which forms the connecting portion of the first cover 363. The first refrigerant pipe 15*a*, which serves as the external device (the external device), is connected to the first union 367*a*. FIG. 11 is a partial enlarged cross-sectional view of the first refrigerant pipe 15*a* and the first union 367*a*, which are connected together.

As shown in FIG. 11, a nut 350 is rotatably supported by an outer peripheral surface of the first refrigerant pipe 15*a*. Furthermore, the nut 350 is configured to threadably engage a threaded portion (screw thread), which is formed in an outer peripheral surface of the first union 367*a*. In addition, a removal limiting portion 351 is provided in the outer peripheral surface of the distal end portion (downstream end portion) of the first refrigerant pipe 15*a* and circumferentially extends all around the distal end portion of the first refrigerant pipe 15*a*. The removal limiting portion 351 limits removal of the nut 350 from the first refrigerant pipe 15*a*.

Then, in the engaged state of the first union 367*a* where the distal end portion of the first refrigerant pipe 15*a* is placed in the first union 367*a*, the nut 350 is tightened against the threaded portion of the first union 367*a*. Thereby, the first refrigerant pipe 15*a* is connected to the ejector 36. At this time, an O-ring 352 is interposed between the first union 367*a* and the removal limiting portion 351 to limit leakage of the refrigerant to the outside through a gap between the first refrigerant pipe 15*a* and the first union 367*a*.

Furthermore, the first evaporator 17 is connected to the outlet opening of the ejector 36 through the third refrigerant pipe 15*c*. That is, the third refrigerant pipe 15*c*, which serves as the external device, is connected to the second union 367*b*.

Next, a manufacturing method of the ejector 36 of the present embodiment will be described. First, with reference to FIG. 10, a functional unit forming process is executed to form the ejector functional unit 360 by connecting the nozzle 361 and the body 362 together. Specifically, the nozzle 361 and the body 362 are connected together by press-fitting the nozzle 361 into the interior of the fixing portion 362*a* of the body 362.

Next, a first connecting process is executed to connect the nozzle 361 side portion (upstream side portion) of the ejector functional unit 360 to the first cover 363. Specifically, the nozzle 361 is press fitted into the first cover 363. Furthermore, a second connecting process is executed to connect the second cover 364 to the first cover 363.

Specifically, the first screw thread 363*b* of the first cover 363 and the second screw thread 364*b* of the second cover 364 are threadably engaged with each other and are tightened with each other, so that the second cover 364 is connected to the first cover 363 without contacting the entire ejector functional unit 360, i.e., without contacting any part of the ejector functional unit 360. Therefore, in the second connecting process, the first cover 363 and the second cover 364 are fixed with each other by the fixing means (non-thermal fixing means), which does not involve heating.

In this way, the first cover 363 receives the nozzle 361 side portion (upstream side portion) of the ejector functional unit 360. Furthermore, the second cover 364 receives the intermediate portion (the portion around the refrigerant suction openings 362*b*) to the body 362 side portion of the ejector functional unit 360. That is, the second cover 364 receives the downstream side portion of the ejector functional unit 360, which is other than the upstream side portion of the ejector functional unit 360 received in the first cover 363. In this way, the ejector 36 is produced.

In the present embodiment, the ejector 36, which is manufactured in the above described manner, is used, so that the advantages described below can be implemented.

First, in the ejector 36 of the present embodiment, the first and second unions 367*a*, 367*b* are provided to the first and second covers 363, 364, respectively, so that the installability of the ejector 36 to the external devices can be improved. Furthermore, at the time of connecting the first and'second unions 367*a*, 367*b* to the first and second refrigerant pipes 15*a*, 15*c*, respectively, even when the second cover 364 is deformed, it is possible to limit the deformation of the ejector functional unit 360.

Specifically, even when the second cover 364 is deformed upon application of a torsional stress to the second cover 364 at the time of tightening the nuts of the first and third refrigerant pipes 15*a*, 15*c* to the first and second unions 367*a*, 367*b*, the torsional stress is not conducted from the second cover 364 to the ejector functional unit 360 since the second cover

364 does not contact the entire ejector functional unit 360, i.e., does not contact any part of the ejector functional unit 360.

Therefore, it is possible to reliably limit the deformation of the ejector functional unit 360. Thus, it is possible to reliably limit the deterioration of the performance of the ejector 36, which would be caused by the deformation of the respective corresponding parts of the ejector 36 at the time of connecting the ejector 36 to the external devices.

Furthermore, the nozzle 361 and the body 362 are connected together to form the ejector functional unit 360. Therefore, the specification of the nozzle 361 and the specification of the body 362 can be changed independently. Therefore, the specification of the ejector 36 can be easily changed.

Also, the annular space S is formed between the outer peripheral surface of the ejector functional unit 360 (specifically, the body 362) and the inner peripheral surface of the second cover 364. Therefore, it is possible to reduce the weight of the ejector.

In addition, at the time of manufacturing the ejector 36, the second cover 364 is fixed to the first cover 363 by the non-thermal fixing means. Therefore, the ejector functional unit 360 is not heated. Therefore, it is possible to limit the thermal deformation of the ejector functional unit 360, and thereby it is possible to limit the deterioration of the performance, which would be caused by the deformations of the respective corresponding parts of the ejector 36, at the time of manufacturing the ejector.

Seventh Embodiment

A seventh embodiment of the present invention is a modification of the sixth embodiment. Specifically, as shown in FIG. 12, according to the present embodiment, a rubber element (serving as a resilient member) 370, which is configured into a generally cylindrical tubular form, is provided in the space S, more specifically in the gap between the second cover 364 and the diffuser portion 362*d* side end portion (downstream end portion) of the ejector functional unit 360 in the ejector 36 of the sixth embodiment.

Figure 12:
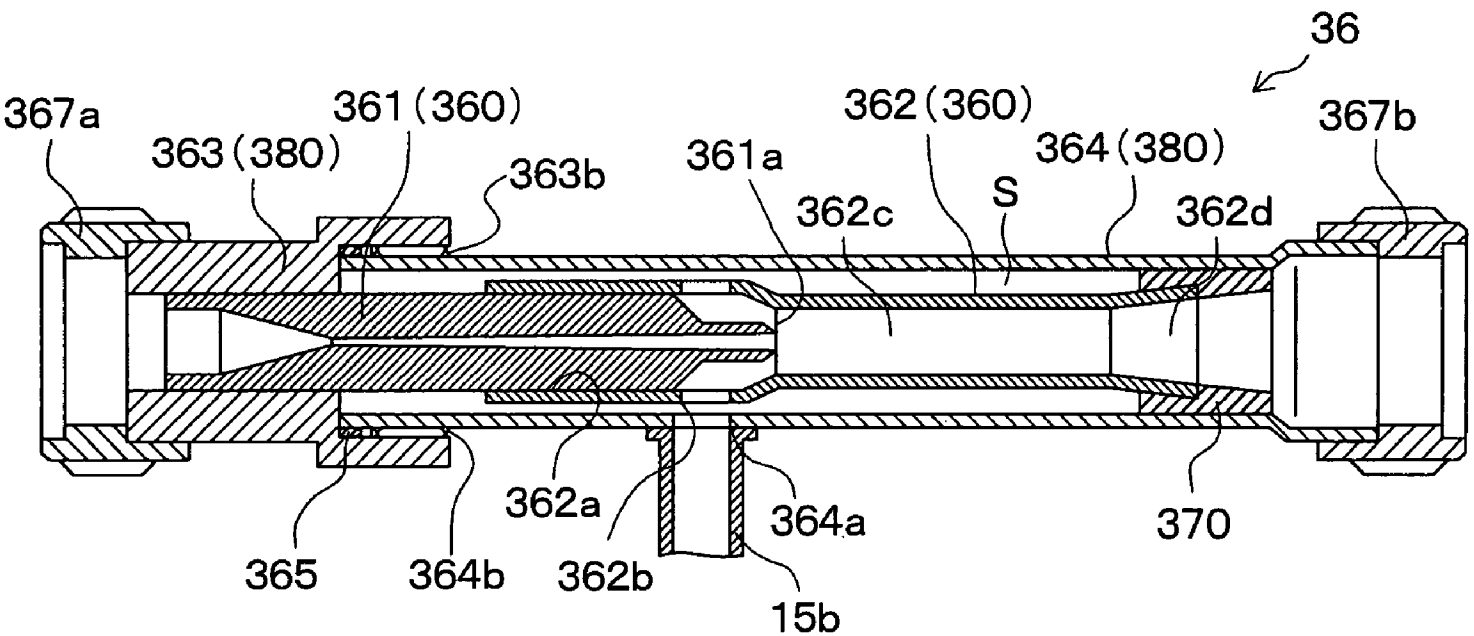
FIG. 12 is an enlarged cross-sectional view of an ejector according to a seventh embodiment of the present invention.

FIG. 12 is an axial cross-sectional view of the ejector 36 of the present embodiment. In FIG. 12, components, which are similar to those of the sixth embodiment, will be indicated by the same reference numerals. This is also true for the other remaining drawings discussed below.

Specifically, the rubber element 370 is made of a rubber material (e.g., isoprene rubber, nitrile rubber or ethylene-propylene rubber), which is highly corrosion resistant to the refrigerant and the lubricant oil. The rubber element 370 is configured into a generally cylindrical tubular form. Furthermore, an outer peripheral surface of the rubber element 370 resiliently and fluid tightly engages the second cover 364.

An upstream side portion of an inner peripheral surface of the rubber element 370, which is located at the upstream side in the flow direction of the refrigerant, resiliently engages the outer peripheral surface of the diffuser portion 362*d* of the body 362. Furthermore, a downstream side portion of the inner peripheral surface of the rubber element 370, which is located at the downstream side in the flow direction of the refrigerant, forms the extension of the inner peripheral surface of the diffuser portion 362*d*, which extends from the inner peripheral surface of the pressurizing portion 362*d* in the flow direction of the refrigerant, so that the downstream side portion of the inner peripheral surface of the rubber element 370 continuously and smoothly extends from the inner peripheral surface of the diffuser portion 362*d* to form a conical surface that defines an inner diameter, which progressively increases toward the downstream side in the flow direction of the refrigerant. The other remaining structure of the ejector 36 is the same as that of the sixth embodiment.

In the ejector 36 of the present embodiment, the rubber element 370 provides the fluid-tight seal to limit the leakage of the refrigerant, which is outputted from the ejector functional unit 360, from the gap between the second cover 364 and the ejector functional unit 360. Furthermore, at the time of connecting the ejector 36 to the external devices, even when the second cover 364 is deformed, it is possible to limit the deformation of the ejector functional unit 360.

Also, since the inner peripheral surface of the rubber element 370 is formed as the extension of the inner peripheral surface of the diffuser portion 362*d*, it is possible to improve the performance (pressurizing performance, i.e., pressure increasing performance) of the ejector 36.

Eighth Embodiment

Figure 13:
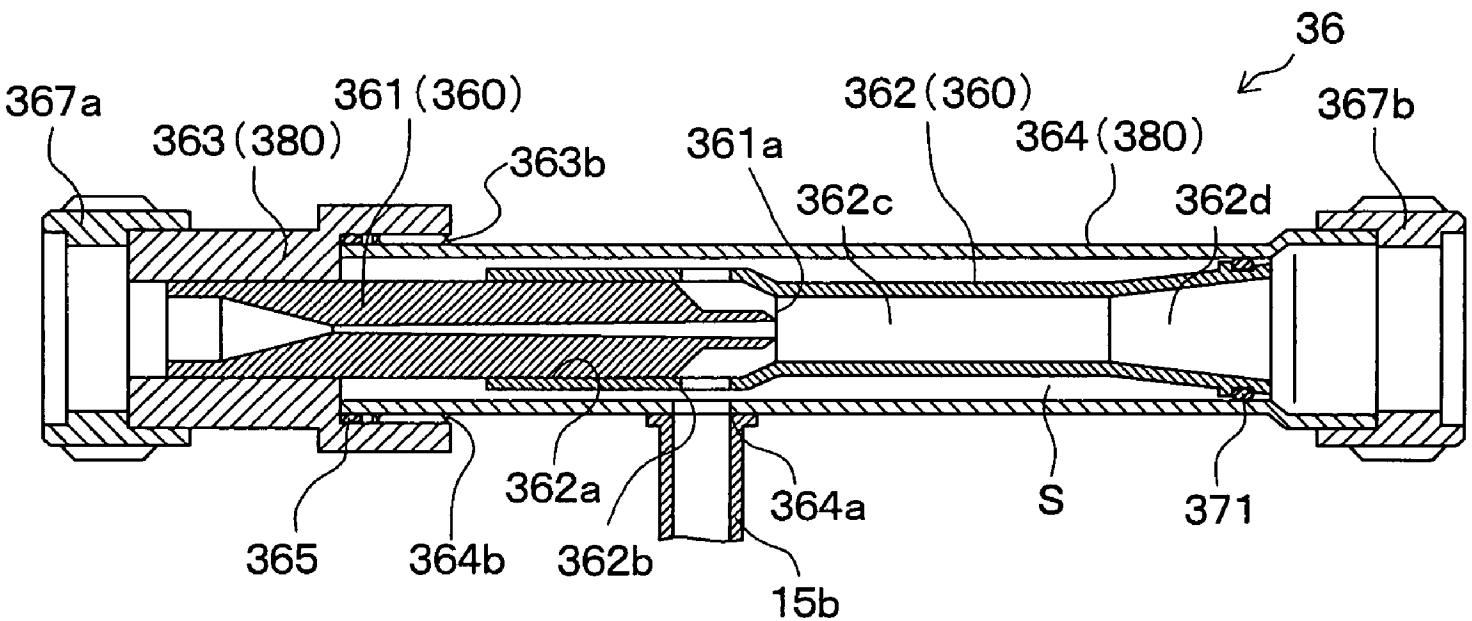
FIG. 13 is an enlarged cross-sectional view of an ejector according to an eighth embodiment of the present invention.

In the seventh embodiment, the generally cylindrical rubber element 370 is used as the resilient member. Alternatively, according to an eighth embodiment of the present invention, as shown in FIG. 13, an O-ring 371 is used as the resilient member. FIG. 13 is an axial cross-sectional view of the ejector 36 of the present embodiment. The other remaining structure of the ejector 36 is the same as that of the sixth embodiment. In the ejector of the present embodiment, the leakage of the refrigerant, which is outputted from the ejector functional unit 360, from the gap between the second cover 364 and the ejector functional unit 360 is limited by the O-ring 371, i.e., is limited with the simple structure.

Ninth Embodiment

In the sixth embodiment, the outer peripheral wall surface of the nozzle 361 of the ejector functional unit 360 is securely press fitted to the inner peripheral wall surface of the first cover 363. Alternatively, according to a ninth embodiment of the present invention, as shown in FIG. 14, the fixing portion 362*a* of the body 362 is constructed to cover the entire nozzle 361, and the outer peripheral wall surface of the body 362 of the ejector functional unit 360 is securely press fitted to the inner peripheral wall surface of the first cover 363.

Figure 14:
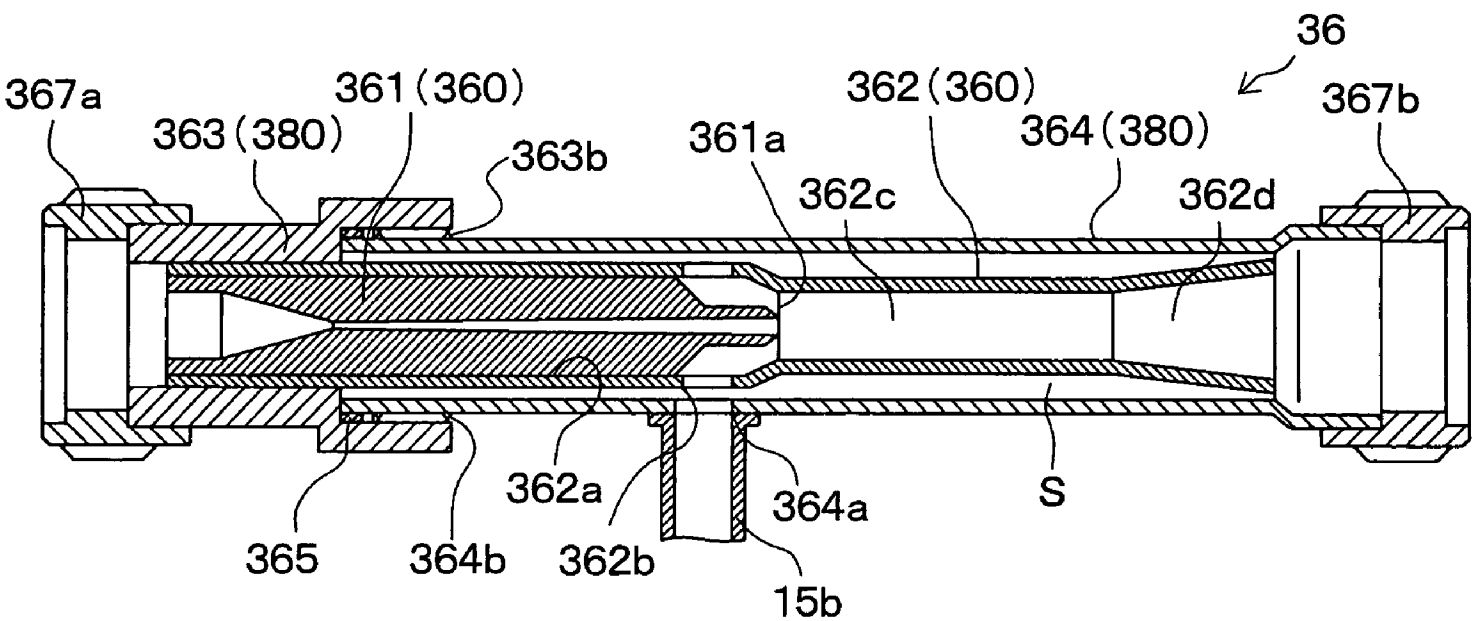
FIG. 14 is an enlarged cross-sectional view of an ejector according to a ninth embodiment of the present invention.

FIG. 14 is an axial cross-sectional view of the ejector 36 of the present embodiment. The other remaining structure of the ejector 36 is the same as that of the sixth embodiment. Even when the ejector 36 is constructed in this manner according to the present embodiment, advantages, which are similar to those of the sixth embodiment, can be achieved. Furthermore, it is possible to provide the resilient member (the rubber element 370 or the O-ring 371), which is similar to that of the seventh or eighth embodiment, to the ejector 36 of the present embodiment.

Tenth Embodiment

Figure 15:
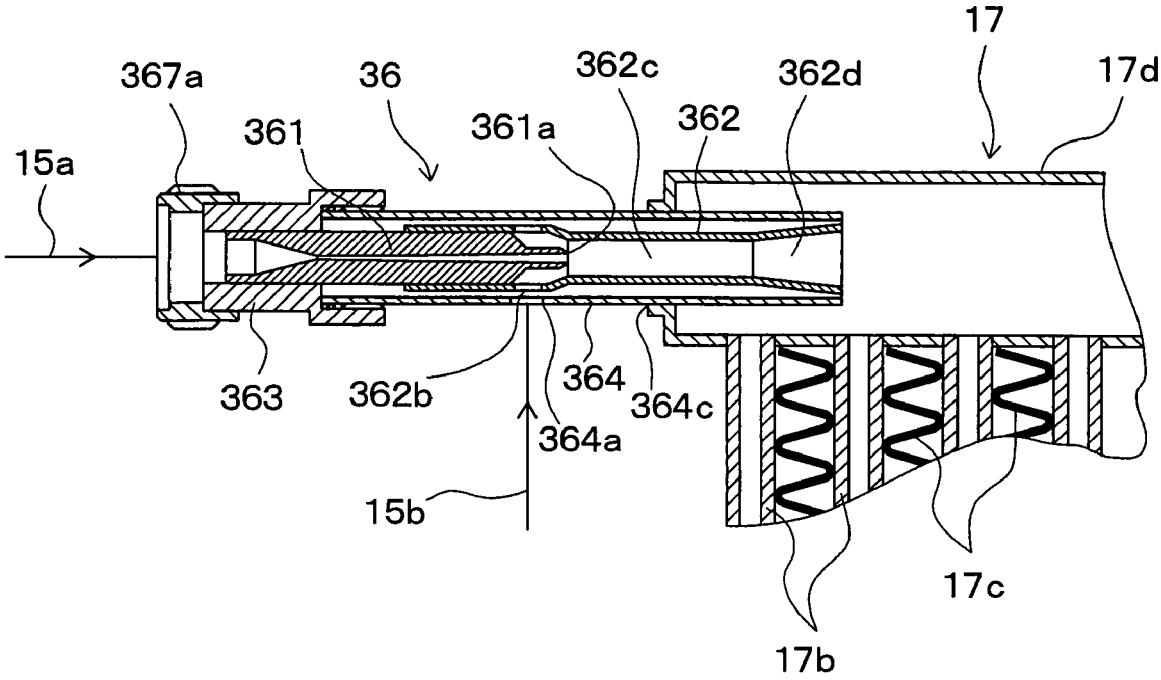
FIG. 15 is a partial enlarged cross-sectional view showing an ejector and a first evaporator according to a tenth embodiment of the present invention.

In a tenth embodiment of the present invention, as shown in FIG. 15, the second cover 364 is formed as a pipe, which is previously connected to, i.e., which is pre-installed to the inlet opening of the first evaporator (serving as the external device) 17. Therefore, the second union 367*b* is not connected to the end portion of the second cover 364. Furthermore, the third refrigerant pipe 15*c*, which connects between the ejector 36 and the first evaporator 17, is also eliminated. FIG. 15 is a partial cross-sectional view showing the ejector 36 and the first evaporator 17 of the present embodiment.

Specifically, the first evaporator 17 of the present embodiment is a known tank and tube type heat exchanger. Specifically, the first evaporator 17 includes upper and lower tanks 17*d* (only the upper tank 17*d* is depicted for the sake of simplicity), a plurality of tubes 17*b* and corrugate fins 17*c*. The upper and lower tanks 17*d* are used to accumulate and distribute the refrigerant. The tubes 17*b* extend between the upper and lower tanks 17*d* to communicate between the upper and lower tanks 17*d*. The corrugate fins 17*c* have the wavy shape and are placed between each adjacent two tubes 17*b* to promote the heat exchange.

Furthermore, the second cover 364 of the present embodiment is previously connected to, i.e., is pre-installed to the first evaporator 17 by soldering the second cover 364 (more specifically, a connecting portion 364*c* at the outer peripheral surface of the second cover 364) to the corresponding tank 17*d* (the upper tank in this instance), through which the refrigerant is supplied to the first evaporator 17. The other remaining structure is the same as that of the sixth embodiment.

Therefore, according to the present embodiment, while advantages similar to those of the sixth embodiment can be achieved, the ejector functional unit 360 can be received in the tube connected to the tank 17*d*. Thus, the external device and the ejector 36 can be easily integrated (can be easily made as the unit) to allow the size reduction. Furthermore, the ejector 36 can be easily connected to the external device.

Also, the integration of the ejector 36 and the external device is not limited to the above described manner. For example, the branch connection 14, the fixed choke 18 and the second evaporator 19 may be further integrated in the integrated structure of the external device and the ejector 36.

The six to tenth embodiments discussed above may be modified as follows.

(1) In the sixth to tenth embodiments, the second cover 364 is fixed to the first cover 363 such that the second cover 364 does not contact the entire ejector functional unit 360, i.e., does not contact any part of the ejector functional unit 360. However, the present invention is not limited to this. Specifically, it is only required to fix the second cover 364 to the first cover 363 in such a manner that the second cover 364 does not contact the diffuser portion 362*d* side end portion (downstream end portion) of the ejector functional unit 360.

For example, in the case where the second cover 364 contacts the outer peripheral surface of the nozzle 361 side portion (upstream side portion) of the ejector functional unit 360, even when the second cover 364 is deformed at the time of connecting the second cover 364 to the external device, it is possible to limit the deformation of the ejector functional unit 360.

(2) In the sixth to tenth embodiments, in the case where the first cover 363 is connected to the second cover 364, the expanded pipe portion 363*a* is provided in the first cover 363, and the second cover 364 is fixed to the inside of the expanded pipe portion 363*a* of the first cover 363. Alternatively, it is possible to provide an expanded pipe portion in the second cover 364 to fix the first cover 363 to the inside of the expanded pipe portion of the second cover 364.

(3) in the second connecting process, the first screw thread 363*b* of the first cover 363 and the second screw thread 364*b* of the second cover 364 are tightened together to connect between the second cover 364 and the first cover 363. Alternatively, any other non-thermal fixing means may be used to connect between the second cover 364 and the first cover 363. For example, other fixing means, such as press-fitting, swaging or bonding, may be used to connect between the second cover 364 and the first cover 363.

Furthermore, as long as the thermal deformation does not occur in the ejector functional unit 360, it is possible to use the fixing means, which involves the heating. Specifically, spot welding may be used to implement the fixing.

(4) In each of the above embodiments, the ordinary chlorofluorocarbon refrigerant is used as the refrigerant. However, the type of the refrigerant is not limited to this. For example, hydrocarbon refrigerant or carbon dioxide may be used as the refrigerant of the above embodiments. Furthermore, the ejector of the present invention may be applied to a supercritical refrigeration cycle, in which the high pressure side refrigerant pressure exceeds the critical pressure.

(5) In each of the above embodiments, the ejector refrigeration cycle 10, which includes the above discussed ejector 36, is applied to the vehicle air conditioning system. However, the application of the present invention is not limited to this. For example, the ejector refrigeration cycle 10 may be applied to the stationary refrigeration cycle. Furthermore, the application of the ejector 36 of the present invention is not limited to the ejector refrigeration cycle 10.

Additional advantages and modifications will readily occur to those skilled in the art. The invention in its broader terms is therefore not limited to the specific details, representative apparatus, and illustrative examples shown and described. Furthermore, any one or more components of one of the above embodiments and modifications thereof may be combined with one or more components of any other one of the above embodiments and modifications thereof to form an ejector, if desired. For example, the suction opening side pipe 266 of the fourth embodiment may be provided to the second cover 364 of the sixth to tenth embodiments. Also, the third union 167*c* of the first embodiment may be provided to this suction opening side pipe 266 in the manner similar to that of the first embodiment.

What is claimed is:

1. An ejector comprising:

an ejector functional unit that includes a nozzle, which depressurizes and expands high pressure fluid supplied thereto, and a body, which is joined to the nozzle, wherein the body has:

a fluid suction opening, through which fluid is drawn into an interior of the body by a vacuum force created by high velocity fluid that is discharged from the nozzle; and a pressurizing portion, in which a mixture of the fluid discharged from the nozzle and the fluid drawn through the fluid suction opening is pressurized; and a housing that is configured into a tubular form and receives at least a portion of the ejector functional unit, wherein:

a housing side opening radially penetrates through an outer peripheral wall surface and an inner peripheral wall surface of the housing and communicates with the fluid suction opening of the body;

the housing side opening is adapted to join with a suction opening side external device, through which the fluid is drawn into the fluid suction opening;

the housing includes:

a first cover that is configured into a tubular form and receives an upstream side portion of the elector functional unit, at which the nozzle is located;

a second cover that is configured into a tubular form and receives a downstream side portion of the ejector functional unit, at which the pressurizing portion is located; and a block that has first to third openings, which are in communication with each other, wherein:

a downstream end portion of the first cover is joined to the first opening of the block;

an upstream end portion of the second cover is joined to the second opening of the block;

the block is positioned relative to the ejector functional unit such that the third opening of the block, which forms the housing side opening, communicates with the fluid suction opening of the body; and at least one of an upstream end portion of the first cover and a downstream end portion of the second cover has a connecting portion, which is adapted to connect with a corresponding external device.

2. The ejector according to claim 1, wherein:

the ejector functional unit is formed by joining a portion of the nozzle to an upstream end portion of the body in a state where the portion of the nozzle is inserted into the body; and the upstream end portion of the body, into which the portion of the nozzle is inserted, projects outwardly from the housing.

3. The ejector according to claim 1, further comprising a suction opening side pipe that conducts the fluid to the housing side opening, wherein:

a downstream end portion of the suction opening side pipe is joined to the housing side opening; and a suction opening side connecting portion is provided in an upstream end portion of the suction opening side pipe and is adapted to connect with the suction opening side external device.

4. The ejector according to claim 1, further comprising a nozzle side pipe that conducts the fluid to the nozzle, wherein:

a downstream end portion of the nozzle side pipe is joined to an inlet opening of the nozzle; and a nozzle side connecting portion is provided in an upstream end portion of the nozzle side pipe and is adapted to connect with a nozzle side external device that conducts the fluid to the nozzle.

5. The ejector according to claim 1, wherein:

a downstream end portion of the body, at which the pressurizing portion is located, projects outwardly from the housing; and a pressurizing portion side connecting portion is provided in the downstream end portion of the body and is adapted to connect with a pressurizing portion side external device that conducts the fluid outputted from the pressurizing portion.

6. The ejector according to claim 1, wherein:

the downstream end portion of the body, at which the pressurizing portion is located, is received in the housing without projecting outwardly from the housing;

a pressurizing portion side connecting portion is provided in a downstream end portion of the housing, at which the pressurizing portion is located; and the pressurizing portion side connecting portion is adapted to connect with a pressurizing portion side external device that conducts the fluid outputted from the pressurizing portion.

7. The ejector according to claim 1, wherein the connecting portion includes a fastening member that is adapted to be mechanically fastened to the corresponding external device.

8. The ejector according to claim 1, wherein a space is defined between an outer peripheral wall surface of the ejector functional unit and an inner peripheral wall surface of the second cover.

9. The ejector according to claim 1, further comprising a suction opening side pipe, through which the fluid is conducted to the fluid suction opening of the body, wherein:

a downstream end portion of the suction opening side pipe is joined to the third opening of the block; and a suction opening side connecting portion is provided in an upstream end portion of the suction opening side pipe and is adapted to connect with the suction opening side external device, through which the fluid is drawn into the fluid suction opening.

10. The ejector according to claim 9, wherein the suction opening side connecting portion includes a fastening member that is adapted to be mechanically fastened to the suction opening side external device.

11. An ejector comprising:

an ejector functional unit that includes a nozzle, which depressurizes and expands high pressure fluid supplied thereto, and a body, which is joined to the nozzle, wherein the body has:

a fluid suction opening, through which fluid is drawn into an interior of the body by a vacuum force created by high velocity fluid that is discharged from the nozzle; and a pressurizing portion, in which a mixture of the fluid discharged from the nozzle and the fluid drawn through the fluid suction opening is pressurized; and a housing that is configured into a tubular form and receives at least a portion of the ejector functional unit, wherein:

a housing side opening radially penetrates through an outer peripheral wall surface and an inner peripheral wall surface of the housing and communicates with the fluid suction opening of the body;

the housing side opening is adapted to join with a suction opening side external device, through which the fluid is drawn into the fluid suction opening;

the housing includes:

a first cover that is configured into a tubular form and receives an upstream side portion of the ejector functional unit, at which the nozzle is located; and a second cover that is configured into a tubular form and receives a downstream side portion of the ejector functional unit, which is other than the upstream side portion of the ejector functional unit received in the first cover;

at least one of an upstream end portion of the first cover and a downstream end portion of the second cover has a connecting portion, which is adapted to connect with a corresponding external device;

the ejector functional unit and the second cover are fixed to the first cover; and the second cover is fixed without contacting at least a downstream end portion of the ejector functional unit, at which the pressurizing portion is located.

12. The ejector according to claim 11, wherein the connecting portion includes a fastening member that is adapted to be mechanically fastened to the corresponding external device.

13. The ejector according to claim 11, wherein the second cover is fixed without contacting any part of the ejector functional unit.

14. The ejector according to claim 11, wherein a resilient member is provided in a space, which is defined between the second cover and the body.

15. The ejector according to claim 14, wherein:

the resilient member is a rubber element that is configured into a generally cylindrical tubular form and is provided to the downstream end portion of the ejector functional unit, at which the pressurizing portion is located;

an inner peripheral surface of the rubber element forms an extension of an inner peripheral surface of the pressurizing portion, which extends from the inner peripheral surface of the pressurizing portion in a flow direction of the fluid.

16. The ejector according to claim 14, wherein the resilient member is an O-ring.

17. The ejector according to claim 11, wherein the second cover is a tube that is pre-installed to the corresponding external device.

18. The ejector according to claim 1, wherein a downstream end portion of the nozzle, which forms a discharge opening of the nozzle, is entirely received in the interior of the body.

19. The ejector according to claim 1, wherein:

an annular space, which circumferentially extends all around the body, is radially defined between the body and the housing; and the annular space is radially interposed between the fluid suction opening of the body and the housing side opening of the housing to communicate therebetween.

20. A manufacturing method for manufacturing an ejector, comprising:

connecting a nozzle and a body together to form an ejector functional unit;

connecting a downstream end portion of a first cover to a first opening of a block and also an upstream end portion of a second cover to a second opening of the block to form a housing that receives the ejector functional unit; and fixing the ejector functional unit into the housing such that an upstream side portion of the ejector functional unit, at which the nozzle is located, is received in the first cover while a downstream side portion of the ejector functional unit, at which a pressurizing portion is located, is received in the second cover, and a third opening of the block is communicated with a fluid suction opening of the body.

21. The manufacturing method according to claim 20, wherein the fixing of the ejector functional unit into the housing includes fixing the ejector functional unit and the housing together by a non-thermal fixing means.

22. A manufacturing method for manufacturing an ejector, comprising:

connecting a nozzle and a body together to form an ejector functional unit;

connecting an upstream side portion of the ejector functional unit, at which the nozzle is located, to a first cover of a housing; and connecting a second cover of the housing to the first cover after the connecting of the upstream side portion of the ejector functional unit to the first cover such that the second cover does not contact a downstream end portion of the ejector functional unit, at which a pressurizing portion is located.

23. The manufacturing method according to claim 22, wherein the connecting of the second cover to the first cover includes fixing the first cover and the second cover together by a non-thermal fixing means.

* * * * *